US007140445B2

(12) United States Patent
Shahin et al.

(10) Patent No.: US 7,140,445 B2
(45) **Date of Patent: *Nov. 28, 2006**

(54) METHOD AND APPARATUS FOR DRILLING WITH CASING

(75) Inventors: David Shahin, Houston, TX (US); Jeff Habetz, Houston, TX (US); David M. Haugen, League City, TX (US); Gary Thompson, Katy, TX (US); Bernd-Georg Pietras, Wedemark (DE); Jimmy L. Hollingsworth, Lafayette, LA (US); Bernd Reinholdt, Hannover (DE)

(73) Assignee: Weatherford/Lamb, Inc., Houston, TX (US)

( * ) Notice: Subject to any disclaimer, the term of this patent is extended or adjusted under 35 U.S.C. 154(b) by 281 days.

This patent is subject to a terminal disclaimer.

(21) Appl. No.: 10/794,797

(22) Filed: Mar. 5, 2004

(65) Prior Publication Data

US 2004/0251050 A1 Dec. 16, 2004

Related U.S. Application Data

(63) Continuation-in-part of application No. 10/625,840, filed on Jul. 23, 2003, now Pat. No. 7,073,598, and a continuation-in-part of application No. 10/389,483, filed on Mar. 14, 2003, and a continuation-in-part of application No. 10/382,353, filed on Mar. 5, 2003, which is a continuation-in-part of application No. 10/354,226, filed on Jan. 29, 2003, now Pat. No. 6,668,398, which is a continuation of application No. 09/860,127, filed on May 17, 2001, now Pat. No. 6,742,596, which is a continuation-in-part of application No. 09/486,901, filed as application No. PCT/GB98/02582 on Sep. 2, 1998, now Pat. No. 6,591,471.

(60) Provisional application No. 60/452,318, filed on Mar. 5, 2003, provisional application No. 60/451,965, filed on Mar. 5, 2003.

(51) Int. Cl.
*E21B 19/16* (2006.01)

(52) U.S. Cl. ..... 166/380; 166/77.52; 166/85.1; 175/85; 294/86.24; 294/86.29

(58) Field of Classification Search ..... None
See application file for complete search history.

(56) References Cited

U.S. PATENT DOCUMENTS 122,514 A 1/1872 Bullock (Continued)

FOREIGN PATENT DOCUMENTS

CA 2 335 192 11/2001

(Continued)

OTHER PUBLICATIONS

PCT Search Report, International Application No. PCT/US2004/006752, dated Sep. 3, 2004.

(Continued)

*Primary Examiner*—Zakiya W. Bates
(74) *Attorney, Agent, or Firm*—Patterson & Sheridan, LLP

(57) ABSTRACT

Methods and apparatus for drilling with a top drive system are provided. In one aspect, a top drive system includes a top drive, top drive adapter, and a tubular positioning apparatus. In another aspect, the top drive adapter is pivotably connected to the top drive for pivoting the top drive adapter toward the casing string with respect to the top drive. In another aspect, the system includes a telescopic link system connected to a lower portion of the top drive adapter to move the casing string into engagement with the top drive adapter. In another aspect, the top drive adapter includes a housing operatively connected to the top drive and a plurality of retaining members disposed in the housing for gripping the tubular. In another aspect, the tubular positioning apparatus includes a gripping member for engaging a tubular and a conveying member for positioning the gripping member. A spinner may be provided to rotate the tubular.

35 Claims, 18 Drawing Sheets

U.S. PATENT DOCUMENTS

| | | | |
|---|---|---|---|
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,825,026 | A | 9/1931 | Thomas |
| 1,830,625 | A | 11/1931 | Schrock |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |
| 1,998,833 | A | 4/1935 | Crowell |
| 2,017,451 | A | 10/1935 | Wickersham |
| 2,049,450 | A | 8/1936 | Johnson |
| 2,060,352 | A | 11/1936 | Stokes |
| 2,105,885 | A | 1/1938 | Hinderliter |
| 2,167,338 | A | 7/1939 | Murcell |
| 2,214,429 | A | 9/1940 | Miller |
| 2,216,895 | A | 10/1940 | Stokes |
| 2,228,503 | A | 1/1941 | Boyd et al. |
| 2,295,803 | A | 9/1942 | O'Leary |
| 2,305,062 | A | 12/1942 | Church et al. |
| 2,324,679 | A | 7/1943 | Cox |
| 2,370,832 | A | 3/1945 | Baker |
| 2,379,800 | A | 7/1945 | Hare |
| 2,414,719 | A | 1/1947 | Cloud |
| 2,499,630 | A | 3/1950 | Clark |
| 2,522,444 | A | 9/1950 | Grable |
| 2,536,458 | A | 1/1951 | Munsinger |
| 2,610,690 | A | 9/1952 | Beatty |
| 2,621,742 | A | 12/1952 | Brown |
| 2,627,891 | A | 2/1953 | Clark |
| 2,641,444 | A | 6/1953 | Moon |
| 2,650,314 | A | 8/1953 | Hennigh et al. |
| 2,663,073 | A | 12/1953 | Bieber et al. |
| 2,668,689 | A | 2/1954 | Cormany |
| 2,692,059 | A | 10/1954 | Boilling, Jr. |
| 2,720,267 | A | 10/1955 | Brown |
| 2,738,011 | A | 3/1956 | Mabry |
| 2,741,907 | A | 4/1956 | Genender et al. |
| 2,743,087 | A | 4/1956 | Layne et al. |
| 2,743,495 | A | 5/1956 | Eklund |
| 2,764,329 | A | 9/1956 | Hampton |
| 2,765,146 | A | 10/1956 | Williams |
| 2,805,043 | A | 9/1957 | Williams |
| 2,953,406 | A | 9/1960 | Young |
| 2,978,047 | A | 4/1961 | DeVaan |
| 3,006,415 | A | 10/1961 | Bums et al. |
| 3,041,901 | A | 7/1962 | Knights |
| 3,054,100 | A | 9/1962 | Jones |
| 3,087,546 | A | 4/1963 | Wooley |
| 3,090,031 | A | 5/1963 | Lord |
| 3,102,599 | A | 9/1963 | Hillburn |
| 3,111,179 | A | 11/1963 | Albers et al. |
| 3,117,636 | A | 1/1964 | Wilcox et al. |
| 3,122,811 | A | 3/1964 | Gilreath |
| 3,123,160 | A | 3/1964 | Kammerer |
| 3,124,023 | A | 3/1964 | Marquis et al. |
| 3,131,769 | A | 5/1964 | Rochemont |
| 3,159,219 | A | 12/1964 | Scott |
| 3,169,592 | A | 2/1965 | Kammerer |
| 3,191,677 | A | 6/1965 | Kinley |
| 3,191,680 | A | 6/1965 | Vincent |
| 3,193,116 | A | 7/1965 | Kenneday et al. |
| 3,353,599 | A | 11/1967 | Swift |
| 3,380,528 | A | 4/1968 | Timmons |
| 3,387,893 | A | 6/1968 | Hoever |
| 3,392,609 | A | 7/1968 | Bartos |
| 3,419,079 | A | 12/1968 | Current |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,550,684 | A | 12/1970 | Cubberly, Jr. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,552,848 | A | 1/1971 | Van Wagner |
| 3,559,739 | A | 2/1971 | Hutchison |
| 3,566,505 | A | 3/1971 | Martin |
| 3,570,598 | A | 3/1971 | Johnson |
| 3,575,245 | A | 4/1971 | Cordary et al. |
| 3,602,302 | A | 8/1971 | Kluth |
| 3,603,411 | A | 9/1971 | Link |
| 3,603,412 | A | 9/1971 | Kammerer, Jr. et al. |
| 3,603,413 | A | 9/1971 | Grill et al. |
| 3,606,664 | A | 9/1971 | Weiner |
| 3,624,760 | A | 11/1971 | Bodine |
| 3,635,105 | A | 1/1972 | Dickmann et al. |
| 3,656,564 | A | 4/1972 | Brown |
| 3,662,842 | A | 5/1972 | Bromell |
| 3,669,190 | A | 6/1972 | Sizer et al. |
| 3,680,412 | A | 8/1972 | Mayer et al. |
| 3,691,624 | A | 9/1972 | Kinley |
| 3,691,825 | A | 9/1972 | Dyer |
| 3,692,126 | A | 9/1972 | Rushing et al. |
| 3,696,332 | A | 10/1972 | Dickson, Jr. et al. |
| 3,700,048 | A | 10/1972 | Desmoulins |
| 3,729,057 | A | 4/1973 | Werner |
| 3,746,330 | A | 7/1973 | Taciuk |
| 3,747,675 | A | 7/1973 | Brown |
| 3,760,894 | A | 9/1973 | Pitifer |
| 3,776,320 | A | 12/1973 | Brown |
| 3,776,991 | A | 12/1973 | Marcus |
| 3,785,193 | A | 1/1974 | Kinley et al. |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guler |
| 3,870,114 | A | 3/1975 | Pulk et al. |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,915,244 | A | 10/1975 | Brown |
| 3,934,660 | A | 1/1976 | Nelson |
| 3,945,444 | A | 3/1976 | Knudson |
| 3,947,009 | A | 3/1976 | Nelmark |
| 3,964,556 | A | 6/1976 | Gearhart et al. |
| 3,980,143 | A | 9/1976 | Swartz et al. |
| 4,049,066 | A | 9/1977 | Richey |
| 4,054,332 | A | 10/1977 | Bryan, Jr. |
| 4,054,426 | A | 10/1977 | White |
| 4,064,939 | A | 12/1977 | Marquis |
| 4,077,525 | A | 3/1978 | Callegari et al. |
| 4,082,144 | A | 4/1978 | Marquis |
| 4,083,405 | A | 4/1978 | Shirley |
| 4,085,808 | A | 4/1978 | Kling |
| 4,095,865 | A | 6/1978 | Denison et al. |
| 4,100,968 | A | 7/1978 | Delano |
| 4,100,981 | A | 7/1978 | Chaffin |
| 4,127,927 | A | 12/1978 | Hauk et al. |
| 4,133,396 | A | 1/1979 | Tschirky |
| 4,142,739 | A | 3/1979 | Billingsley |
| 4,173,457 | A | 11/1979 | Smith |
| 4,175,619 | A | 11/1979 | Davis |
| 4,186,628 | A | 2/1980 | Bonnice |
| 4,189,185 | A | 2/1980 | Kammerer, Jr. et al. |

4,194,383 A 3/1980 Huzyak
4,221,269 A 9/1980 Hudson
4,227,197 A 10/1980 Nimmo et al.
4,241,878 A 12/1980 Underwood
4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,311,195 A 1/1982 Mullins, II
4,315,553 A 2/1982 Stallings
4,320,915 A 3/1982 Abbott et al.
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,437,363 A 3/1984 Haynes
4,440,220 A 4/1984 McArthur
4,445,734 A 5/1984 Cunningham
4,446,745 A 5/1984 Stone et al.
4,449,596 A 5/1984 Boyadjieff
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,544,041 A 10/1985 Rinaldi
4,545,443 A 10/1985 Wiredal
4,570,706 A 2/1986 Pugnet
4,580,631 A 4/1986 Baugh
4,583,603 A 4/1986 Dorleans et al.
4,589,495 A 5/1986 Langer et al.
4,592,125 A 6/1986 Skene
4,593,773 A 6/1986 Skeie
4,595,058 A 6/1986 Nations
4,604,724 A 8/1986 Shaginian et al.
4,604,818 A 8/1986 Inoue
4,605,077 A 8/1986 Boyadjieff
4,605,268 A 8/1986 Meador
4,620,600 A 11/1986 Persson
4,625,796 A 12/1986 Boyadjieff
4,630,691 A 12/1986 Hooper
4,646,827 A 3/1987 Cobb
4,649,777 A 3/1987 Buck
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak
4,762,187 A 8/1988 Haney
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al.
4,878,546 A 11/1989 Shaw et al.
4,880,058 A 11/1989 Lindsey et al.
4,883,125 A 11/1989 Wilson et al.
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al.
5,009,265 A 4/1991 Bailey et al.
5,022,472 A 6/1991 Bailey et al.
5,027,914 A 7/1991 Wilson
5,036,927 A 8/1991 Willis
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,109,924 A 5/1992 Jurgens et al.
5,111,893 A 5/1992 Kvello-Aune
5,141,063 A 8/1992 Quesenbury
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski
5,172,765 A 12/1992 Sas-Jaworsky et al.
5,176,518 A 1/1993 Hordijk et al.

5,181,571 A 1/1993 Mueller
5,186,265 A 2/1993 Henson et al.
5,191,932 A 3/1993 Seefried et al.
5,191,939 A 3/1993 Stokley
5,197,553 A 3/1993 Leturno
6,374,506 B1 4/1993 Clay
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson
5,255,741 A 10/1993 Alexander
5,255,751 A 10/1993 Stogner
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al.
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry
5,392,715 A 2/1995 Pelrine
5,394,823 A 3/1995 Lenze
5,402,856 A 4/1995 Warren et al.
5,433,279 A 7/1995 Tessari et al.
5,435,400 A 7/1995 Smith
5,452,923 A 9/1995 Smith
5,456,317 A 10/1995 Hood, III, et al.
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,547,029 A 8/1996 Rubbo et al.
5,551,521 A 9/1996 Vail, III
5,553,672 A 9/1996 Smith, Jr. et al.
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al.
5,582,259 A 12/1996 Barr
5,584,343 A 12/1996 Coone
5,588,916 A 12/1996 Moore
5,613,567 A 3/1997 Hudson
5,615,747 A 4/1997 Vail, III
5,645,131 A 7/1997 Trevisani
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III
5,735,351 A 4/1998 Helms
5,743,344 A 4/1998 McLeod et al.
5,746,276 A 5/1998 Stuart
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al.
5,794,703 A 8/1998 Newman et al.
5,803,191 A 9/1998 Mackintosh
5,803,716 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al.
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.
5,971,079 A 10/1999 Mullins
5,971,086 A 10/1999 Bee et al.
5,984,007 A 11/1999 Yuan et al.

5,988,273 A 11/1999 Monjure et al.
6,000,472 A 12/1999 Albright et al.
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al.
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al.
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,290,432 B1 9/2001 Exley et al.
6,296,066 B1 10/2001 Terry et al.
6,305,469 B1 10/2001 Coenen et al.
6,309,002 B1 10/2001 Bouligny
6,311,792 B1 11/2001 Scott et al.
6,315,051 B1 11/2001 Ayling
6,325,148 B1 12/2001 Trahan et al.
6,343,649 B1 2/2002 Beck et al.
6,347,674 B1 2/2002 Bloom et al.
6,349,764 B1 2/2002 Adams et al.
6,357,485 B1 3/2002 Quigley et al.
6,359,569 B1 3/2002 Beck et al.
6,360,633 B1 3/2002 Pietras
6,367,552 B1 4/2002 Scott et al.
6,367,566 B1 4/2002 Hill
6,371,203 B1 4/2002 Frank et al.
6,374,706 B1 4/2002 Newman
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B1 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al.
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny
6,433,241 B1 8/2002 Juhasz et al.
6,443,241 B1 9/2002 Juhasz et al.
6,443,247 B1 9/2002 Wardley
6,446,723 B1 9/2002 Ramos et al.
6,457,532 B1 10/2002 Simpson
6,458,471 B1 10/2002 Lovato et al.
6,464,004 B1 10/2002 Crawford et al.
6,464,011 B1 10/2002 Tubel
6,484,818 B1 11/2002 Alft et al.
6,497,280 B1 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B1 3/2003 Birckhead et al.
6,536,993 B1 3/2003 Strong et al.
6,538,576 B1 3/2003 Schultz et al.
6,540,025 B1 4/2003 Scott et al.
6,543,552 B1 4/2003 Metcalfe et al.
6,547,017 B1 4/2003 Vail, III
6,553,825 B1 4/2003 Boyd
6,554,064 B1 4/2003 Restarick et al.
6,585,040 B1 7/2003 Hanton et al.
6,591,471 B1 7/2003 Hollingsworth
6,595,288 B1 7/2003 Mosing et al.
6,619,402 B1 9/2003 Amory et al.
6,622,796 B1 9/2003 Pietras
6,634,430 B1 10/2003 Dawson et al.
6,637,526 B1 10/2003 Juhasz et al.
6,648,075 B1 11/2003 Badrak et al.
6,651,737 B1 11/2003 Bouligny
6,655,460 B1 12/2003 Bailey et al.
6,666,274 B1 12/2003 Hughes
6,668,684 B1 12/2003 Allen et al.
6,668,937 B1 12/2003 Murray
6,679,333 B1 1/2004 York et al.
6,688,394 B1 2/2004 Ayling
6,688,398 B1 2/2004 Pietras
6,691,801 B1 2/2004 Juhasz et al.
6,698,595 B1 3/2004 Norell et al.
6,702,040 B1 3/2004 Sensenig
6,708,769 B1 3/2004 Haugen et al.
6,715,430 B1 4/2004 Choi et al.
6,719,071 B1 4/2004 Moyes
6,725,924 B1 4/2004 Davidson et al.
6,725,938 B1 4/2004 Pietras
6,732,822 B1 5/2004 Slack et al.
6,742,584 B1 6/2004 Appleton
6,742,596 B1 6/2004 Haugen
6,742,606 B1 6/2004 Metcalfe et al.
6,745,834 B1 6/2004 Davis et al.
6,752,211 B1 6/2004 Dewey et al.
6,832,658 B1 12/2004 Keast
6,837,313 B1 1/2005 Hosie et al.
6,840,322 B1 1/2005 Haynes
6,848,517 B1 2/2005 Wardley
6,854,533 B1 2/2005 Galloway
6,857,486 B1 2/2005 Chitwood et al.
6,857,487 B1 2/2005 Galloway et al.
2001/0000101 A1 4/2001 Lovato et al.
2001/0002626 A1 6/2001 Frank et al.
2001/0013412 A1 8/2001 Tubel
2001/0040054 A1 11/2001 Haugen et al.
2001/0042625 A1 11/2001 Appleton
2001/0047883 A1 12/2001 Hanton et al.
2002/0040787 A1 4/2002 Cook et al.

| | | | |
|---|---|---|---|
| 2002/0066556 | A1 | 6/2002 | Goode et al. |
| 2002/0074127 | A1 | 6/2002 | Birckhead et al. |
| 2002/0074132 | A1 | 6/2002 | Juhasz et al. |
| 2002/0079102 | A1 | 6/2002 | Dewey et al. |
| 2002/0108748 | A1 | 8/2002 | Keyes |
| 2002/0134555 | A1 | 9/2002 | Allen et al. |
| 2002/0157829 | A1 | 10/2002 | Davis et al. |
| 2002/0162690 | A1 | 11/2002 | Hanton et al. |
| 2002/0170720 | A1 | 11/2002 | Haugen |
| 2002/0189806 | A1 | 12/2002 | Davidson et al. |
| 2002/0189863 | A1 | 12/2002 | Wardley |
| 2003/0029641 | A1 | 2/2003 | Meehan |
| 2003/0034177 | A1 | 2/2003 | Chitwood et al. |
| 2003/0056947 | A1 | 3/2003 | Cameron |
| 2003/0056991 | A1 | 3/2003 | Hahn et al. |
| 2003/0070841 | A1 | 4/2003 | Merecka et al. |
| 2003/0070842 | A1 | 4/2003 | Bailey et al. |
| 2003/0111267 | A1 | 6/2003 | Pia |
| 2003/0141111 | A1 | 7/2003 | Pia |
| 2003/0146023 | A1 | 8/2003 | Pia |
| 2003/0164250 | A1 | 9/2003 | Wardley |
| 2003/0164251 | A1 | 9/2003 | Tulloch |
| 2003/0164276 | A1 | 9/2003 | Snider et al. |
| 2003/0173073 | A1 | 9/2003 | Snider et al. |
| 2003/0173090 | A1 | 9/2003 | Cook et al. |
| 2003/0213598 | A1 | 11/2003 | Hughes |
| 2003/0217865 | A1 | 11/2003 | Simpson et al. |
| 2003/0221519 | A1 | 12/2003 | Haugen et al. |
| 2004/0000405 | A1 | 1/2004 | Fournier, Jr. et al. |
| 2004/0003490 | A1 | 1/2004 | Shahin et al. |
| 2004/0003944 | A1 | 1/2004 | Vincent et al. |
| 2004/0011534 | A1 | 1/2004 | Simonds et al. |
| 2004/0016575 | A1 | 1/2004 | Shahin et al. |
| 2004/0060697 | A1 | 4/2004 | Tilton et al. |
| 2004/0069500 | A1 | 4/2004 | Haugen |
| 2004/0069501 | A1 | 4/2004 | Haugen et al. |
| 2004/0079533 | A1 | 4/2004 | Buytaert et al. |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0096846 | A1 | 5/2005 | Koithan et al. |

FOREIGN PATENT DOCUMENTS

| | | |
|---|---|---|
| DE | 3 213 464 | 10/1983 |
| DE | 3 523 221 | 2/1987 |
| DE | 35 23 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 617 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 716 761 | 10/1954 |
| GB | 7 928 86 | 4/1958 |
| GB | 8 388 33 | 6/1960 |
| GB | 881 358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1988 |
| GB | 2 201 912 | 9/1988 |
| GB | 2 216 926 | 10/1989 |
| GB | 2 223 253 | 4/1990 |
| GB | 2 224 481 | 9/1990 |
| GB | 2 240 799 | 8/1991 |
| GB | 2 275 486 | 4/1993 |
| GB | 2 294 715 | 5/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| RU | 2 079 633 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |

| | | |
|---|---|---|
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1618870 | 1/1991 |
| SU | 1808972 | 5/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/24728 | 12/1993 |
| WO | WO 95/10686 | 4/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/01651 | 1/1998 |
| WO | WO 98/05844 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 00/04269 | 1/2000 |
| WO | WO 00/05483 | 2/2000 |
| WO | WO 00/08293 | 2/2000 |
| WO | WO 00/09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00/50730 | 8/2000 |
| WO | WO 00/66879 | 11/2000 |
| WO | WO 01/12946 | 2/2001 |
| WO | WO 01/46550 | 6/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/14649 | 2/2002 |
| WO | WO 02/44601 | 6/2002 |
| WO | WO 02/081863 | 10/2002 |
| WO | WO 02/086287 | 10/2002 |
| WO | WO 03/006790 | 1/2003 |
| WO | WO 03/074836 | 9/2003 |
| WO | WO 03/087525 | 10/2003 |
| WO | WO 2004/022903 | 3/2004 |

OTHER PUBLICATIONS

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.

M.B. Stone and J. Smith, "Expandable Tubulars and Casing Drilling are Options" Drilling Contractor, Jan./Feb. 2002, pp. 52.

M. Gelfgat, "Retractable Bits Development and Application" Transactions of the ASME, vol. 120, Jun. (1998), pp. 124-130.

"First Success with Casing-Drilling" World Oil, Feb. (1999), pp. 25.

Dean E. Gaddy, Editor, "Russia Shares Technical Know-How with U.S." Oil & Gas Journal, Mar. (1999), pp. 51-52 and 54-56.

U.S. Appl. No. 10/794,797, filed Mar. 5, 2004.

Rotary Steerable Technology—Technology Gains Momentum, Oil & Gas Journal, Dec. 28, 1998.

Directional Drilling, M. Mims, World Oil, May 1999, pp. 40-43.

Multilateral Classification System w/Example Applications, Alan MacKenzie & Cliff Hogg, World Oil, Jan. 1999, pp. 55-61.

Tarr, et al., "Casing-while-Drilling: The Next Step Change In Well Construction," World Oil, Oct. 1999, pp. 34-40.

De Leon Mojarro, "Breaking A Paradigm: Drilling With Tubing Gas Wells," SPE Paper 40051, SPE Annual Technical Conference And Exhibition, Mar. 3-5, 1998, pp. 465-472.

De Leon Mojarro, "Drilling/Completing With Tubing Cuts Well Costs By 30%," World Oil, Jul. 1998, pp. 145-150.

Littleton, "Refined Slimhole Drilling Technology Renews Operator Interest," Petroleum Engineer International, Jun. 1992, pp. 19-26.

Anon, "Slim Holes Fat Savings," Journal of Petroleum Technology, Sep. 1992, pp. 816-819.

Anon, "Slim Holes, Slimmer Prospect," Journal of Petroleum Technology, Nov. 1995, pp. 949-952.

Vogt, et al., "Drilling Liner Technology For Depleted Reservoir," SPE Paper 36827, SPE Annual Technical Conference And Exhibition, Oct. 22-24, pp. 127-132.

Mojarro, et al., "Drilling/Completing With Tubing Cuts Well Costs By 30%," World Oil, Jul. 1998, pp. 145-150.

Sinor, et al., Rotary Liner Drilling For Depleted Reservoirs, IADC/SPE Paper 39399, IADC/SPE Drilling Conference, Mar. 3-6, 1998, pp. 1-13.

Editor, "Innovation Starts At The Top At Tesco," The American Oil & Gas Reporter, Apr. 1998, p. 65.

Tessari, et al., "Casing Drilling—A Revolutionary Approach To Reducing Well Costs," SPeEIADC Paper 52789, SPE/IADC Drilling Conference, Mar. 9-11, 1999, pp. 221-229.

Silverman, "Novel Drilling Method—Casing Drilling Process Eliminates Tripping String," Petroleum Engineer International, Mar. 1999, p. 15.

Silverman, "Drilling Technology—Retractable Bit Eliminates Drill String Trips," Petroleum Engineer International, Apr. 1999, p. 15.

Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.

Tessari, et al., "Focus: Drilling With Casing Promises Major Benefits," Oil & Gas Journal, May 17, 1999, pp. 58-62.

Laurent, et al., "Hydraulic Rig Supports Casing Drilling," World Oil, Sep/ 1999, pp. 61-68.

Perdue, et al., "Casing Technology Improves," Hart's E & P, Nov. 1999, pp. 135-136.

Warren, et al., "Casing Drilling Application Design Considerations," IADC/SPE Paper 59179, IADC/SPE Driling Conference, Feb. 23-25, 2000 pp. 1-11.

Warren, et al., "Drilling Technology: Part I—Casing Drilling With Directional Steering In The U.S. Gulf Of Mexico," Offshore, Jan. 2001, pp. 50-52.

Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program:" Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.
Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation And Stage-Cementing System," Journal Of Petroleum Technology, Aug. 1998, pp. 76-77.
Quigley, "Coiled Tubing And Its Applications," SPE Short Course, Houston, Texas, Oct. 3, 1999, 9 pages.
Bayfiled, et al., "Burst And Collapse Of A Sealed Multilateral Junction: Numerical Simulations," SPE/IADC Paper 52873, SPE/IADC Drilling Conference, Mar. 9-11, 1998, 8 pages.
Marker, et al., "Anaconda: Joint Development Project Leads To Digitally Controlled Composite Coiled Tubing Drilling Systems," SPE paper 60750, SPE/ICOTA Coiled Tubing Roundtable, Apr. 5-6, 2000, pp. 1-9.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing And Hydraulic Workover Technologies Into One Integrated Drilling System," IADC/SPE Paper 74538, IADC/SPE Drilling Conference, Feb. 26-28, 2002, pp. 1-7.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conference, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development And Testing Of An Economical Casing Connection For Use In Drilling Operations," paper WOCD-0306-03, WOrld Oil Casing Drilling Technical Conference, Mar. 6-7, 2003, pp. 1-10.
Detlef Hahn, Friedhelm Makohl, and Larry Watkins, Casing-While Drilling System Reduces Hole Collapse Risks, Offshore, pp. 54, 56, and 59, Feb. 1998.
Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.
Tommy Warren, SPE, Bruce Houtchens, SPE, Garret Madell, SPE, Directional Drilling With Casing, SPE/IADC 79914, Tesco Corporation, SPE/IADC Drilling Conference 2003.
LaFleur Petroleum Services, Inc., "Autoseal Circulating Head," Engineering Manufacturing, 1992, 11 Pages.
Valves Wellhead Equipment Safety Systems, W-K-M Division, ACF Industries, Catalog 80, 1980, 5 Pages.
Canrig Top Drive Drilling Systems, Harts Petroleum Engineer International, Feb. 1997, 2 Pages.
The Original Portable Top Drive Drilling System, TESCO Drilling Technology, 1997.
Mike Killalea, Portable Top Drives: What's Driving The Marked?, IADC, Drilling Contractor, Sep. 1994, 4 Pages.
500 or 650 ECIS Top Drive, Advanced Permanent Magnet Motor Technology, TESCO Drilling Technology, Apr. 1998, 2 Pages.
500 or 650 HCIS Top Drive, Powerful Hydraulic Compact Top Drive Drilling System, TESCO Drilling Technology, Apr. 1998, 2 Pages.
Product Information (Sections 1-10) CANRIG Drilling Technology, Ltd., Sep. 18, 1996.
Alexander Sas-Jaworsky and J. G. Williams, Development of Composite Coiled Tubing For Oilfield Services, SPE 26536, Society of Petroleum Engineers, Inc., 1993.
A. S. Jafar, H.H. Al-Attar, and I. S. El-Ageli, Discussion and Comparison of Performance of Horizontal Wells in Bouri Field, SPE 26927, Society of Petroleum Engineers, Inc., 1996.
G. F. Boykin, The Role of A Worldwide Drilling Organization and the Road to the Future, SPE/IADC 37630, 1997.
M. S. Fuller, M. Littler, and I. Pollock, Innovative Way To Cement a Liner Utilizing a New Inner String Liner Cementing Process, 1998.
Helio Santos, Consequences and Relevance of Drillstring Vibration on Wellbore Stability, SPE/IADC 52820, 1999.
Chan L. Daigle, Donald B. Campo, Carey J. Naquin, Rudy Cardenas, Lev M. Ring, Patrick L. York, Exapandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IADC/SPE 59151, 2000.
Kenneth K. Dupal, Donald B. Campo, John E. Lofton, Don Weisinger, R. Lance Cook, Michael D. Bullock, Thomas P. Grant, and Patrick L. York, Solid Expandable Tubular Technology—A Year of Case Histories in the Drilling Environment, SPE/IADC 67770, 2001.
Mike Bullock, Tom Grant, Rick Sizemore, Chan Daigle, and Pat York, Using Expanable Solid Tubulars To Solve Well Construction Challenges In Deep Waters And Maturing Properities, IBP 27500, Brazilian Petroleum Institute—IBP, 2000.
Coiled Tubing Handbook, World Oil, Gulf Publishing Company, 1993.

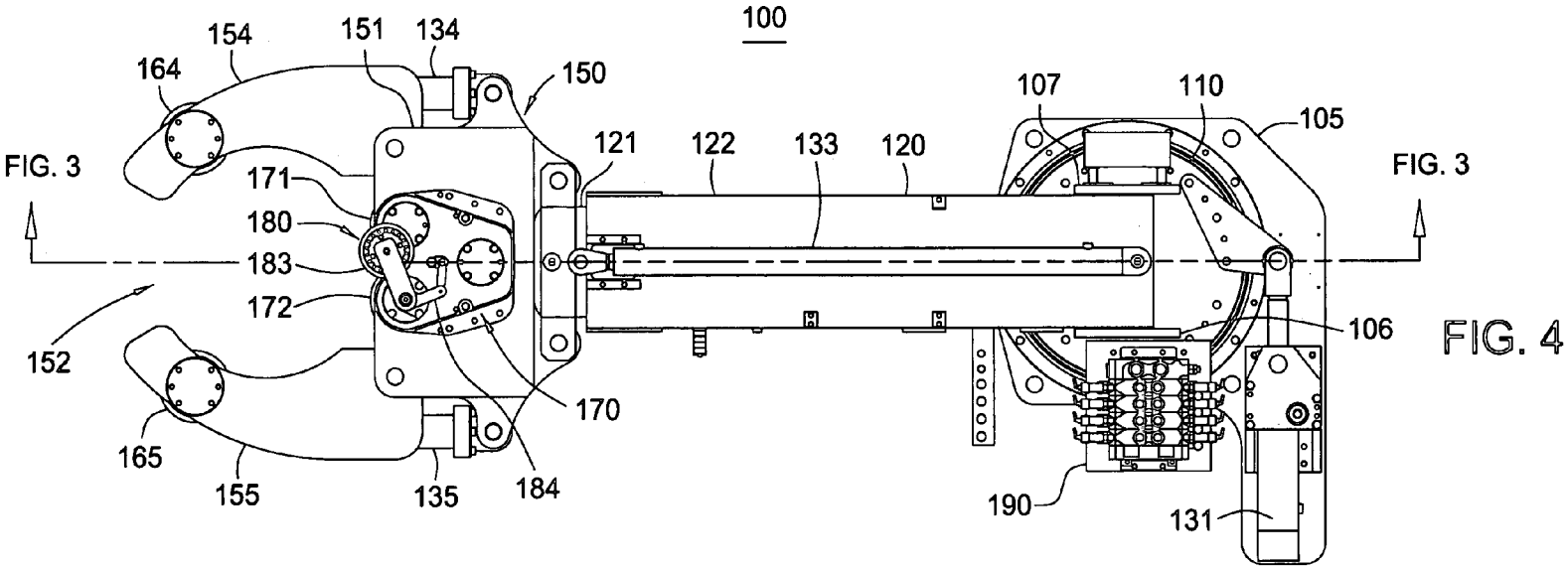
FIG. 4
FIG. 3
FIG. 3
100
105
106
110
107
131
190
120
133
122
121
150
170
184
134
135
151
171
180
183
172
154
155
164
165
152
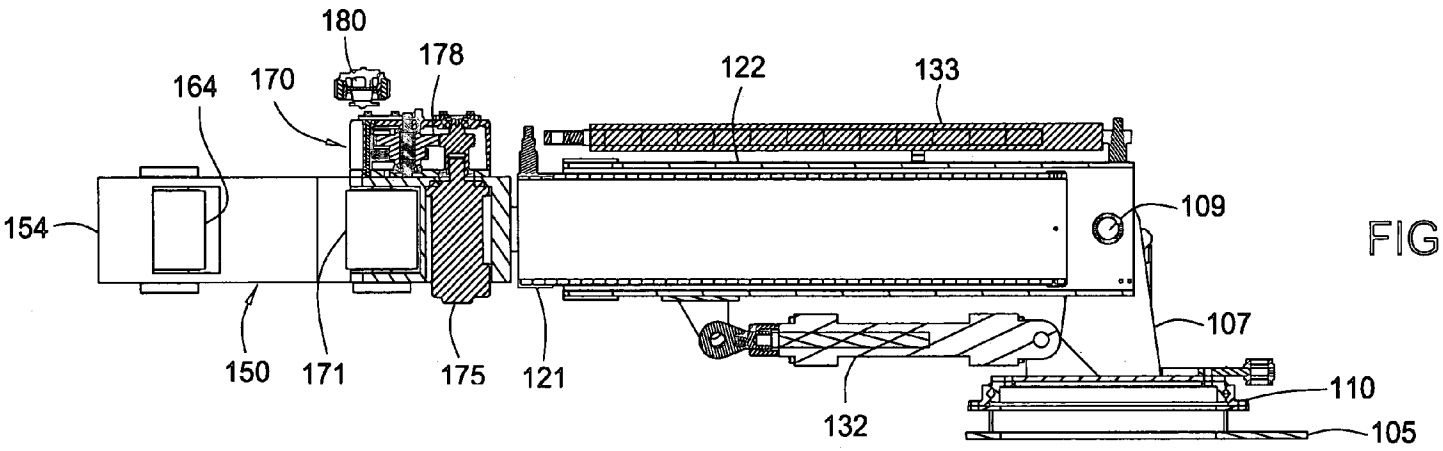
FIG. 5
105
110
107
109
133
132
122
121
175
178
180
171
170
150
164
154

METHOD AND APPARATUS FOR DRILLING WITH CASING

CROSS-REFERENCE TO RELATED APPLICATIONS

This application claims benefit of U.S. Provisional Patent Application Ser. No. 60/452,318, filed Mar. 5, 2003, which application is herein incorporated by reference in its entirety.

This application also claims benefit of U.S. Provisional Patent Application Ser. No. 60/451,965, filed Mar. 5, 2003, which application is herein incorporated by reference in its entirety.

This application is a continuation-in-part of U.S. patent application Ser. No. 10/382,353, filed on Mar. 5, 2003 and published as U.S. Patent Application Publication No. 2004/0003490 on Jan. 8, 2004, which application is a continuation-in-part of U.S. patent application Ser. No. 09/486,901, filed on May 19, 2000, which issued as U.S. Pat. No. 6,591,471 on Jul. 15, 2003, which is the National Stage of International Application No. PCT/GB98/02582, filed on Sep. 2, 1998, and published under PCT article 21(2) in English, which claims priority of United Kingdom Application No. 9718543.3, filed on Sep. 2, 1997. Each of the aforementioned related patent applications is herein incorporated by reference in its entirety.

This application is also a continuation-in-part of U.S. patent application Ser. No. 10/625,840, filed on Jul. 23, 2003 now U.S. Pat. No. 7,073,598, which is a continuation of U.S. patent application Ser. No. 09/860,127, filed on May 17, 2001 and issued as U.S. Pat. No. 6,742,596 on Jun. 1, 2004, which applications and patent are herein incorporated by reference in their entirety.

This application is also a continuation-in-part of U.S. patent application Ser. No. 10/389,483, filed Mar. 14, 2003, which claims benefit of U.S. patent application Ser. No. 09/550,721, filed Apr. 17, 2000 and issued as U.S. Pat. No. 6,536,520 on Mar. 25, 2003. Each of the aforementioned related patent applications is herein incorporated by reference in its entirety.

This application is also a continuation-in-part of U.S. patent application Ser. No. 10/354,226, filed Jan. 29, 2003, and issued as U.S. Pat. No. 6,668,398 on Feb. 10, 2004, which claims benefit of U.S. patent application Ser. No. 09/762,698, filed Aug. 16, 1999 and issued as U.S. Pat No. 6,527,047 on Mar. 4, 2003. Each of the aforementioned related patent applications is herein incorporated by reference in its entirety.

BACKGROUND OF THE INVENTION

1. Field of the Invention

The present invention relates to methods and apparatus for handling tubulars. Particularly, the invention relates to apparatus and methods for positioning, connecting, and rotating tubulars for wellbore operations. More particularly, the present invention relates to apparatus and methods for tubular handling operations for drilling with casing using a top drive system.

2. Description of the Related Art

In well completion operations, a wellbore is formed to access hydrocarbon-bearing formations by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. Using apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, one conventional method to complete a well includes drilling to a first designated depth with a drill bit on a drill string. Then, the drill string is removed and a first string of casing is run into the wellbore and set in the drilled out portion of the wellbore. Cement is circulated into the annulus behind the casing string and allowed to cure. Next, the well is drilled to a second designated depth, and a second string of casing, or liner, is run into the drilled out portion of the wellbore. The second string is set at a depth such that the upper portion of the second string of casing overlaps the lower portion of the first string of casing. The second string is then fixed, or "hung" off of the existing casing by the use of slips, which utilize slip members and cones to wedgingly fix the second string of casing in the wellbore. The second casing string is then cemented. This process is typically repeated with additional casing strings until the well has been drilled to a desired depth. Therefore, two run-ins into the wellbore are required per casing string to set the casing into the wellbore. In this manner, wells are typically formed with two or more strings of casing of an ever-decreasing diameter.

As more casing strings are set in the wellbore, the casing strings become progressively smaller in diameter in order to fit within the previous casing string. In a drilling operation, the drill bit for drilling to the next predetermined depth must thus become progressively smaller as the diameter of each casing string decreases in order to fit within the previous casing string. Therefore, multiple drill bits of different sizes are ordinarily necessary for drilling in well completion operations.

Another method of performing well completion operations involves drilling with casing, as opposed to the first method of drilling and then setting the casing. In this method, the casing string is run into the wellbore along with a drill bit for drilling the subsequent, smaller diameter hole located in the interior of the existing casing string. The drill bit is operated by rotation of the drill string from the surface of the wellbore. Once the borehole is formed, the attached casing string may be cemented in the borehole. The drill bit is either removed or destroyed by the drilling of a subsequent borehole. The subsequent borehole may be drilled by a second working string comprising a second drill bit disposed at the end of a second casing that is of sufficient size to line the wall of the borehole formed. The second drill bit should be smaller than the first drill bit so that it fits within the existing casing string. In this respect, this method requires at least one run-in into the wellbore per casing string that is set into the wellbore.

It is known in the industry to use top drive systems to rotate a drill string to form a borehole. Top drive systems are equipped with a motor to provide torque for rotating the drilling string. The quill of the top drive is typically threadedly connected to an upper end of the drill pipe in order to transmit torque to the drill pipe. Top drives may also be used in a drilling with casing operation to rotate the casing.

In order to drill with casing, most existing top drives require a crossover adapter to connect to the casing. This is because the quill of the top drive is not sized to connect with the threads of the casing. The crossover adapter is design to alleviate this problem. Typically, one end of the crossover adapter is designed to connect with the quill, while the other end is designed to connect with the casing.

However, the process of connecting and disconnecting a casing is time consuming. For example, each time a new casing is added, the casing string must be disconnected from the crossover adapter. Thereafter, the crossover adapter must be threaded into the new casing before the casing string may be run. Furthermore, this process also increases the likelihood of damage to the threads, thereby increasing the potential for downtime.

More recently, top drive adapters have been developed to facilitate the casing handling operations and to impart torque from the top drive to the casing. Generally, top drive adapters are equipped with gripping members to grippingly engage the casing string to transmit torque applied from the top drive to the casing. Top drive adapters may include an external gripping device such as a torque head or an internal gripping device such as a spear.

It is typically necessary to raise or lower the top drive during drilling. For example, the top drive is lowered during drilling in order to urge the drill bit into the formation to extend the wellbore. As the wellbore is extended, additional casings must be added to the casing string. The top drive is released from the casing string and raised to a desired height, thereby allowing the make up of the additional casing to the casing string.

Generally, top drives are disposed on rails so that it is movable axially relative to the well center. While the top drive adapter may rotate relative to the top drive, it is axially fixed relative to the top drive and thus must remain within the same plane as the top drive and well center. Because movement of the torque head and top drive are restricted, a single joint elevator attached to cable bails is typically used to move additional casings from the rack to well center.

Generally, when the casing is transported from the rack to well center, a rig hand is employed to manipulate the cable bails and angle the elevator from its resting position below the top drive adapter to the rack. The elevator is closed around one end of the casing to retain control of the casing. The top drive is then raised to pull the elevator and the attached casing to well center.

Once the elevator lifts the casing from the rack, the casing is placed in alignment with the casing string held in the wellbore. Typically, this task is also performed by a rig hand. Because the free end of the casing is unsupported, this task generally presents a hazard to the personnel on the rig floor as they try to maneuver the casing above the wellbore.

A pipe handling arm has recently been developed to manipulate a first tubular into alignment with a second tubular, thereby eliminating the need of a rig hand to align the tubulars. The pipe handling arm is disclosed in International Application No. PCT/GB98/02582, entitled "Method and Apparatus for Aligning Tubulars" and published on Mar. 11, 1999, which application is herein incorporated by reference in its entirety. The pipe handling arm includes a positioning head mounted on a telescopic arm which can hydraulically extend, retract, and pivot to position the first tubular into alignment with the second tubular.

When drilling with typical drill pipe, a threaded drill pipe connection is usually made up by utilizing a spinner and a power tong. Generally, spinners are designed to provide low torque while rotating the casing at a high rate. On the other hand, power tongs are designed to provide high torque with a low turn rate, such as a half turn only. While the spinner provides a faster make up rate, it fails to provide enough torque to form a fluid tight connection. Whereas the power tong may provide enough torque, it fails to make up the connection in an efficient manner because the power tong must grip the casing several times to tighten the connection. Therefore, the spinner and the power tong are typically used in combination to make up a connection.

To make up the connection, the spinner and the power tong are moved from a location on the rig floor to a position near the well center to rotate the casing into engagement with the casing string. Thereafter, the spinner is actuated to perform the initial make up of the connection. Then, the power tong is actuated to finalize the connection. Because operating time for a rig is very expensive, some as much as $500,000 per day, there is enormous pressure to reduce the time they are used in the formation of the wellbore.

There is a need, therefore, for methods and apparatus to reduce the time it takes to connect or disconnect tubulars. There is also a need for an apparatus for aligning tubulars for connection therewith and partly make up the connection while the power tong is moved into position. There is a further need for apparatus and methods to facilitate the movement of a tubular to and from the well center.

SUMMARY OF THE INVENTION

The present invention generally relates to a method and apparatus for drilling with a top drive system. In one aspect, the present invention provides for a top drive adapter for use with a top drive to grip a tubular. The top drive adapter includes a housing operatively connected to the top drive and a plurality of retaining members disposed in the housing for gripping the tubular. The retaining members may be actuated to radially engage the tubular. In one embodiment, the top drive adapter further includes an insert disposed on the plurality of retaining members. The insert is axially movable relative to the plurality of retaining members. In another embodiment, the contact surface between the insert and the plurality of retaining members is tapered relative to a central axis.

In another aspect, the retaining members define a jaw and a piston and cylinder assembly for moving the jaw radially to engage the tubular. Preferably, the jaw is pivotably connected to the piston and cylinder assembly. The jaw is adapted and designed to transmit an axial load acting on the plurality of retaining members to the housing.

In another aspect still, the present invention provides a top drive system for forming a wellbore with a tubular. The top drive system includes a pipe handling arm for manipulating the tubular; a top drive; and a torque head operatively connected to the top drive. In one embodiment, the torque head includes a housing operatively connected to the top drive and a plurality of retaining members disposed in the housing for gripping the tubular, wherein the plurality of retaining members are actuatable to radially engage the tubular.

In yet another aspect, the present invention provides a method of forming a wellbore with a tubular string having a first tubular and a second tubular. The method includes providing a top drive operatively connected to a torque head, the torque head having a retaining member. Additionally, the method includes engaging the first tubular with a pipe handling arm; engaging the first tubular with the second tubular; and actuating the retaining member to radially engage the first tubular. Then, the first tubular is rotated with respect to the second tubular to make up the tubulars. After the tubulars have been connected, the top drive rotates the new tubular string to form the wellbore. In one embodiment, a portion of a make up process is performed by the pipe handling arm. Thereafter, the make up process is completed using the top drive.

In another aspect, the present invention generally relates to a method and apparatus for connecting a first tubular with a second tubular. The apparatus includes a gripping member for engaging the first tubular and a conveying member for positioning the gripping member. The apparatus also includes a spinner for rotating the first tubular. In one embodiment, the spinner includes a motor and one or more rotational members for engaging the first tubular. In another embodiment, the apparatus includes a rotation counting member biased against the first tubular.

In another aspect, the present invention provides a method of connecting a first tubular to second tubular. The method includes engaging the first tubular using a gripping member connected to a conveying member and positioning the gripping member to align the first tubular with the second tubular. Thereafter, the first tubular is engaged with the second tubular, and the first tubular is rotated relative to the second tubular using the gripping member.

In another embodiment, the method further comprises determining a position of the gripping member, wherein the position of the gripping member aligns the first tubular with the second tubular, and memorizing the position of the gripping member. Additional tubulars may be connected by recalling the memorized position.

In yet another aspect, the present invention provides a top drive system for forming a wellbore with a tubular. The system includes a top drive, a top drive adapter operatively connected to the top drive, and a pipe handling arm. The pipe handling arm may include a gripping arm for engaging the tubular and a conveying member for positioning the gripping member. The pipe handling arm also includes a spinner for connecting the first tubular to the second tubular. In another embodiment, the system may also include an elevator and one or more bails operatively connecting the elevator to the top drive.

In another aspect still, the present invention provides a method of forming a wellbore with a tubular string having a first tubular and a second tubular. The method includes providing a top drive operatively connected to a top drive adapter; engaging the first tubular with a pipe handling arm; and engaging the first tubular with the second tubular. Then, the pipe handling arm rotates the first tubular with respect to the second tubular. Thereafter, the top drive adapter engages the first tubular and the top drive is actuated to rotate tubular string, thereby forming the wellbore.

The present invention generally provides an apparatus for use with a top drive adapter which permits movement along more than one longitudinal line to move a casing string from a location away from well center to well center. In one aspect, the apparatus includes a pivotable mechanism between a top drive adapter and a top drive which permits the top drive adapter to pivot away from the top drive. The top drive adapter is used to retrieve the casing string. The pivotable mechanism pivots the casing string back to well center. Because the top drive adapter sealingly and grippingly engages the casing string above well center, the casing string is capable of axial and rotational movement relative to the top drive and circulating fluid may flow through the top drive adapter and top drive so that a drilling with casing operation may be conducted.

In another aspect, a telescopic link system is connected to the top drive adapter. The telescopic link system includes telescopic links with a tubular retaining apparatus attached to the end of the telescopic links opposite the top drive adapter. Once the top drive adapter is pivoted toward the casing string to pick up the casing string, the telescopic links extend through the space between the top drive adapter and the casing string to retrieve the casing string. The tubular retaining apparatus grippingly engages the casing string, and the telescopic links retract to pull the casing string from its original location. The pivotable mechanism pivots the casing string back to well center. The top drive adapter is then lowered to sealingly and grippingly engage the casing string, and the drilling with casing operation is conducted as above.

In yet another aspect, the telescopic link system is pivotally connected to the top drive adapter at the end of the telescopic links opposite the end of the telescopic links used to pick up the casing string from its location away from well center. The telescopic link system expands and retracts to retrieve the casing string and transport it to well center. The pivotable connection of the telescopic link system to the top drive adapter also transports the casing string to well center.

Providing apparatus and methods for pivoting from the axial line including the top drive on the rails eliminates the need for cable bails with single joint elevators attached thereto to transport the casing string to well center. As such, moving the casing string to well center for a pipe handling operation or drilling with casing operation is safer and thus less expensive as well as more efficient.

BRIEF DESCRIPTION OF THE DRAWINGS

So that the manner in which the above recited features of the present invention, and other features contemplated and claimed herein, are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

FIG. 4 is a top view of the pipe handling arm shown in FIG. 1.

FIG. 5 is a cross-section view of the pipe handling arm along line A—A of FIG. 4.

DETAILED DESCRIPTION OF THE PREFERRED EMBODIMENT

Figure 1:
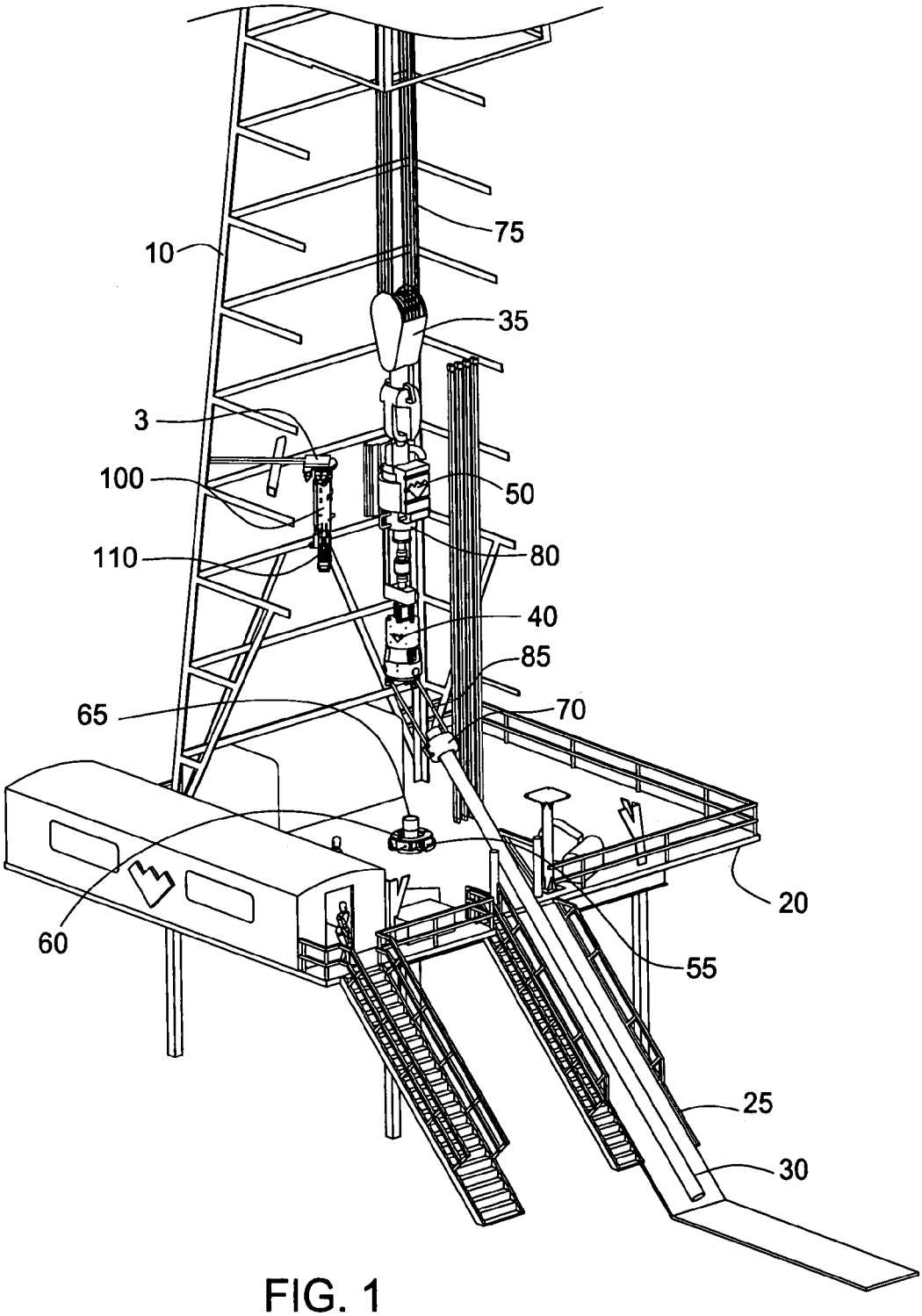
FIG. 1 is a partial view of a rig having a top drive system and a pipe handling arm according to aspects of the present invention.

FIG. 1 shows a drilling rig 10 applicable to drilling with casing operations or a wellbore operation that involves picking up/laying down tubulars. The drilling rig 10 is located above a formation at a surface of a well. The drilling rig 10 includes a rig floor 20 and a v-door (not shown). The rig floor 20 has a hole 55 therethrough, the center of which is termed the well center. A spider 60 is disposed around or within the hole 55 to grippingly engage the casings 30, 65 at various stages of the drilling operation. As used herein, each casing 30, 65 may include a single casing or a casing string having more than one casing, and may include a liner, drill pipe, or other types of wellbore tubulars. Therefore, aspects of the present invention are equally applicable to other types of wellbore tubulars, such as drill pipe and liners.

The drilling rig 10 includes a traveling block 35 suspended by cables 75 above the rig floor 20. The traveling block 35 holds the top drive 50 above the rig floor 20 and may be caused to move the top drive 50 axially. The top drive 50 includes a motor 80 which is used to rotate the casing 30, 65 at various stages of the operation, such as during drilling with casing or while making up or breaking out a connection between the casings 30, 65. A railing system (not shown) is coupled to the top drive 50 to guide the axial movement of the top drive 50 and to prevent the top drive 50 from rotational movement during rotation of the casings 30, 65.

Disposed below the top drive 50 is a torque head 40, which is a type of top drive adapter. The torque head 40 serves as a gripping apparatus and may be utilized to grip an upper portion of the casing 30 and impart torque from the top drive 50 to the casing 30. Another example of a top drive adapter is a spear. A spear typically includes a gripping mechanism which has gripping members disposed on its outer perimeter for engaging the inner surface of the casing 30.

Figure 2:
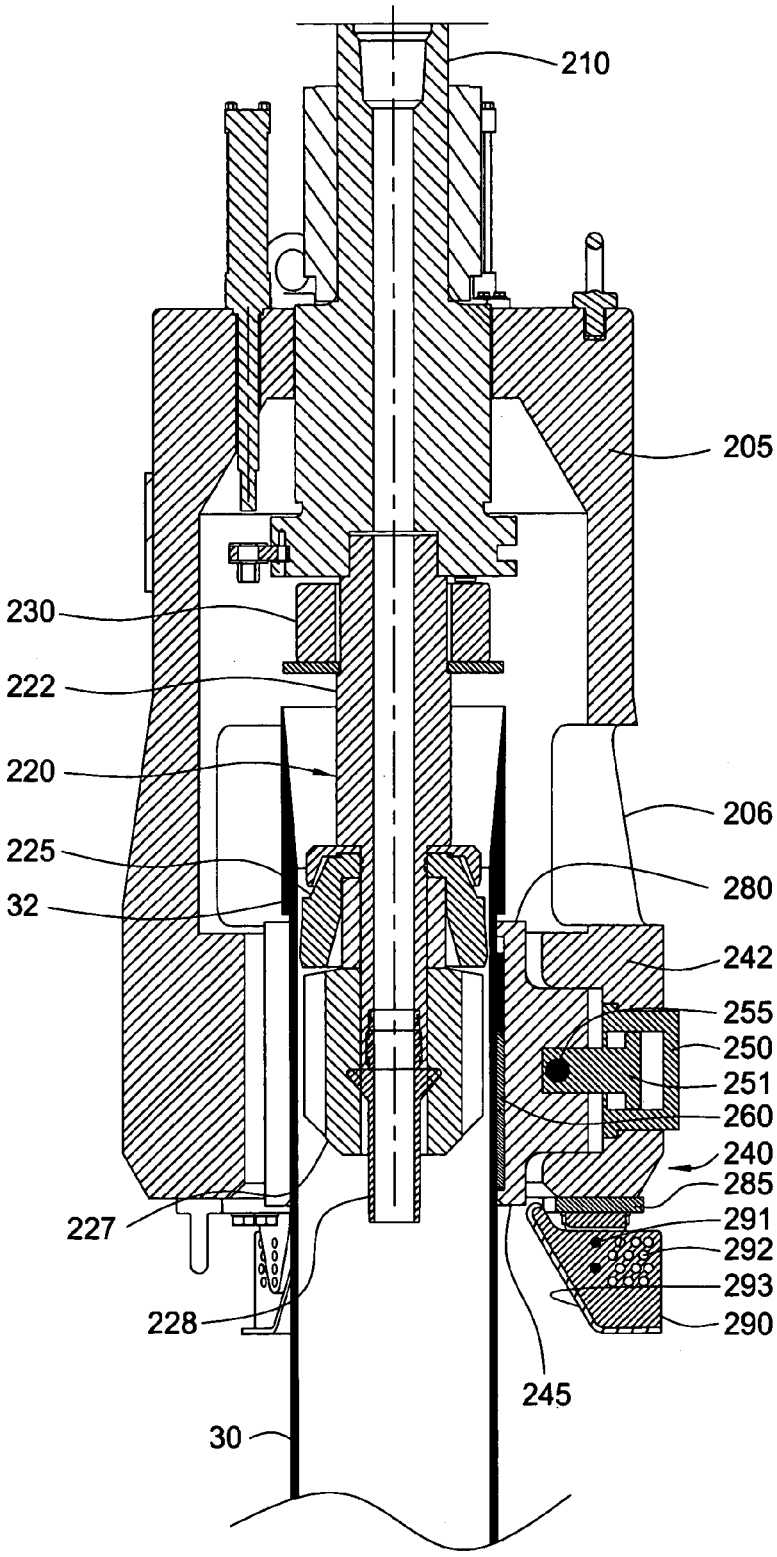
FIG. 2 is a cross-sectional view of a torque head according to aspects of the present invention.

FIG. 2 illustrates cross-sectional view of an exemplary torque head 40 according to aspects of the present invention. The torque head 40 is shown engaged with the casing 30. The torque head 40 includes a housing 205 having a central axis. A top drive connector 210 is disposed at an upper portion of the housing 205 for connection with the top drive 50. Preferably, the top drive connector 210 defines a bore therethrough for fluid communication. The housing 205 may include one or more windows 206 for accessing the housing's interior.

The torque head 40 may optionally employ a circulating tool 220 to supply fluid to fill up the casing 30 and circulate the fluid. The circulating tool 220 may be connected to a lower portion of the top drive connector 210 and disposed in the housing 205. The circulating tool 220 includes a mandrel 222 having a first end and a second end. The first end is coupled to the top drive connector 210 and fluidly communicates with the top drive 50 through the top drive connector 210. The second end is inserted into the casing 30. A cup seal 225 and a centralizer 227 are disposed on the second end interior to the casing 30. The cup seal 225 sealingly engages the inner surface of the casing 30 during operation. Particularly, fluid in the casing 30 expands the cup seal 225 into contact with the casing 30. The centralizer 227 co-axially maintains the casing 30 with the central axis of the housing 205. The circulating tool 220 may also include a nozzle 228 to inject fluid into the casing 30. The nozzle 228 may also act as a mud saver adapter 228 for connecting a mud saver valve (not shown) to the circulating tool 220.

In one embodiment, a casing stop member 230 may be disposed on the mandrel 222 below the top drive connector 210. The stop member 230 prevents the casing 30 from contacting the top drive connector 210, thereby protecting the casing 30 from damage. To this end, the stop member 230 may be made of an elastomeric material to substantially absorb the impact from the casing 30.

In another aspect, one or more retaining members 240 may be employed to engage the casing 30. As shown, the torque head 40 includes three retaining members 240 mounted in spaced apart relation about the housing 205. Each retaining member 240 includes a jaw 245 disposed in a jaw carrier 242. The jaw 245 is adapted and designed to move radially relative to the jaw carrier 242. Particularly, a back portion of the jaw 245 is supported by the jaw carrier 242 as it moves radially in and out of the jaw carrier 242. In this respect, an axial load acting on the jaw 245 may be transferred to the housing 205 via the jaw carrier 242. Preferably, the contact portion of the jaw 245 defines an arcuate portion sharing a central axis with the casing 30. It must be noted that the jaw carrier 242 may be formed as part of the housing 205 or attached to the housing 205 as part of the gripping member assembly.

Movement of the jaw 245 is accomplished by a piston 251 and cylinder 250 assembly. In one embodiment, the cylinder 250 is attached to the jaw carrier 242, and the piston 251 is movably attached to the jaw 245. Pressure supplied to the backside of the piston 251 causes the piston 251 to move the jaw 245 radially toward the central axis to engage the casing 30. Conversely, fluid supplied to the front side of the piston 251 moves the jaw 245 away from the central axis. When the appropriate pressure is applied, the jaws 245 engage the casing 30, thereby allowing the top drive 50 to move the casing 30 axially or rotationally.

In one aspect, the piston 251 is pivotably connected to the jaw 245. As shown in FIG. 2, a pin connection 255 is used to connect the piston 251 to the jaw 245. It is believed that a pivotable connection limits the transfer of an axial load on the jaw 245 to the piston 251. Instead, the axial load is mostly transmitted to the jaw carrier 242 or the housing 205. In this respect, the pivotable connection reduces the likelihood that the piston 251 may be bent or damaged by the axial load. It is understood that the piston 251 and cylinder 250 assembly may include any suitable fluid operated piston 251 and cylinder 250 assembly known to a person of ordinary skill in the art. Exemplary piston and cylinder assemblies include a hydraulically operated piston and cylinder assembly and a pneumatically operated piston and cylinder assembly.

Figure 2A:
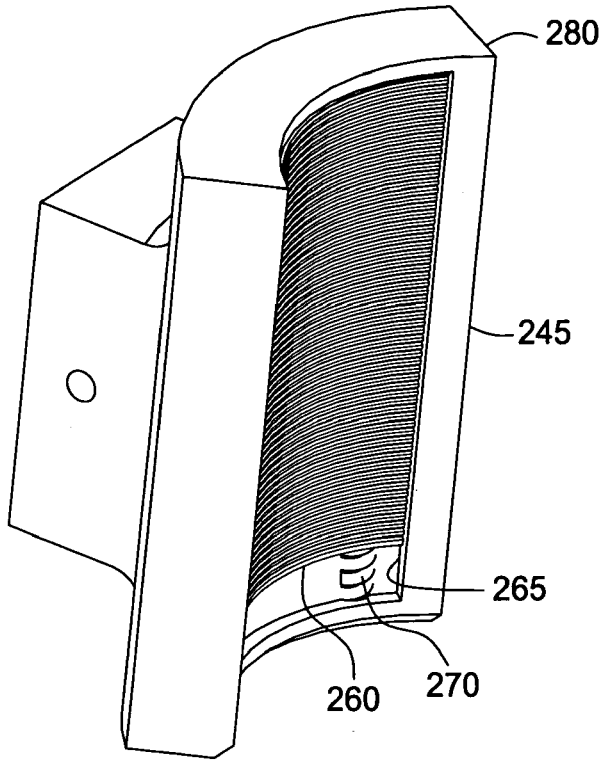
FIGS. 2A–B are isometric views of a jaw for a torque head according to aspects of the present invention.
Figure 2B:
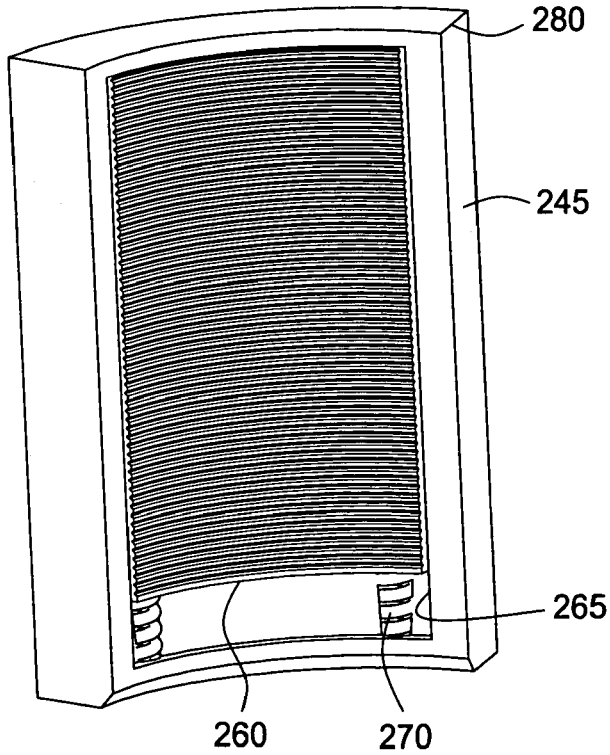
Figure 3:
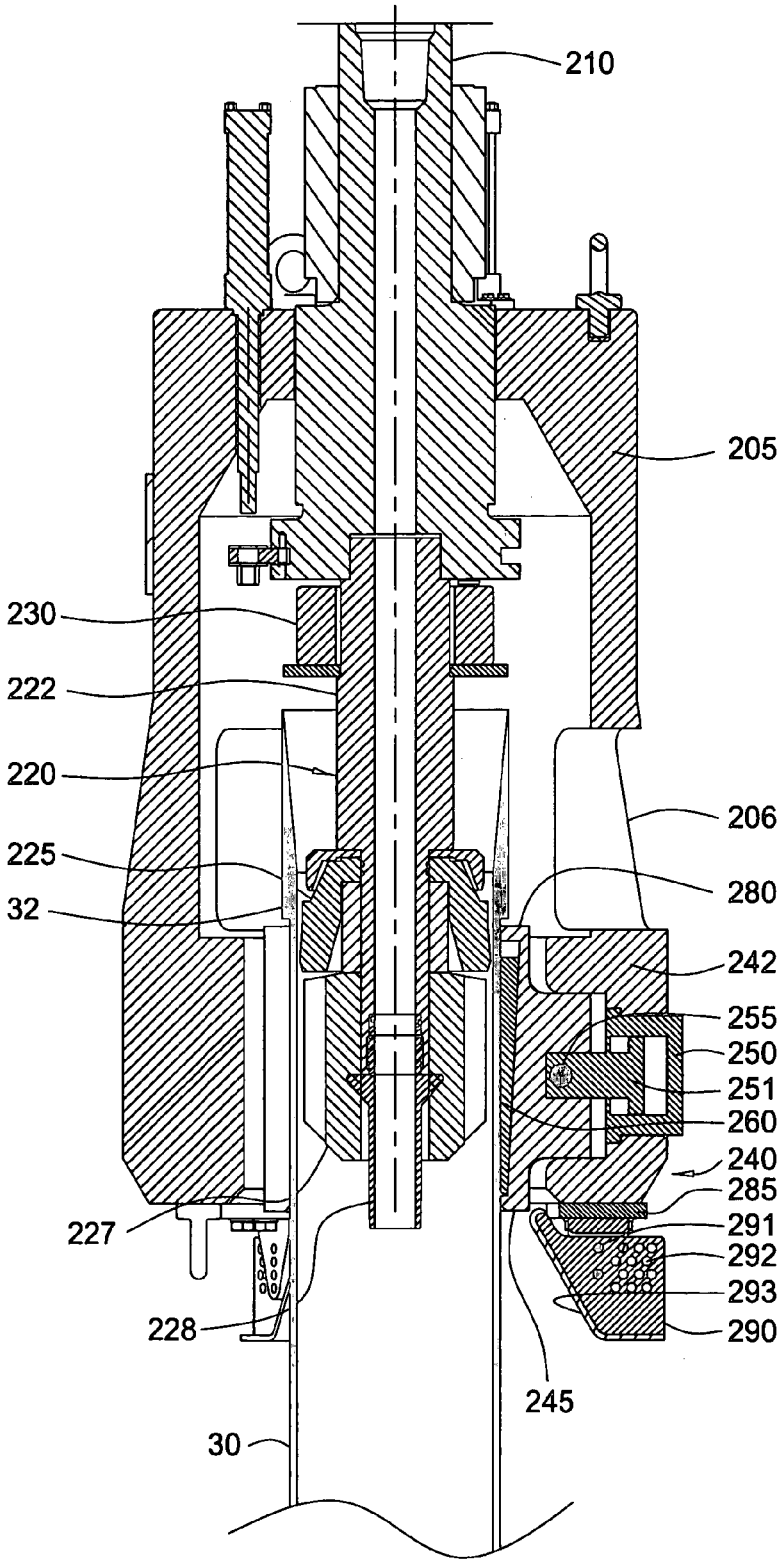
FIG. 3 is a cross-sectional view of another embodiment of a torque head according to aspects of the present invention.

The jaws 245 may include one or more inserts 260 movably disposed thereon for engaging the casing 30. The inserts 260, or dies, include teeth formed on its surface to grippingly engage the casing 30 and transmit torque thereto. In one embodiment, the inserts 260 may be disposed in a recess 265 as shown in FIG. 2A. One or more biasing members 270 may be disposed below the inserts 260. The biasing members 270 allow some relative movement between the casing 30 and the jaw 245. When the casing 30 is released, the biasing member 270 moves the inserts 260 back to the original position. In another embodiment, the contact surface between the inserts 260 and the jaw recess 265 may be tapered. As shown in FIG. 3, the tapered surface is angled relative to the central axis of the casing 30, thereby extending the insert 260 radially as it moves downward along the tapered surface.

In another aspect, the outer perimeter of the jaw 245 around the jaw recess 265 may aide the jaws 245 in supporting the load of the casing 30 and/or casing string 65. In this respect, the upper portion of the perimeter provides a shoulder 280 for engagement with the coupling 32 on the casing 30 as illustrated FIGS. 2 and 2A. The axial load, which may come from the casing string 30, 65, acting on the shoulder 280 may be transmitted from the jaw 245 to the housing 205.

A base plate 285 may be attached to a lower portion of the torque head 40. A guide plate 290 may be selectively attached to the base plate 285 using a removable pin connection. The guide plate 290 has an incline edge 293 adapted and designed to guide the casing 30 into the housing 205. The guide plate 290 may be quickly adjusted to accommodate tubulars of various sizes. In one embodiment, one or more pin holes 292 may be formed on the guide plate 290, with each pin hole 292 representing a certain tubular size. To adjust the guide plate 290, the pin 291 is removed and inserted into the designated pin hole 292. In this manner, the guide plate 290 may be quickly adapted for use with different tubulars.

Referring to FIG. 1, an elevator 70 operatively connected to the torque head 40 may be used to transport the casing 30 from a rack 25 or a pickup/lay down machine to the well center. The elevator 70 may include any suitable elevator known to a person of ordinary skill in the art. The elevator defines a central opening to accommodate the casing 30. In one embodiment, bails 85 are used to interconnect the elevator 70 to the torque head 40. Preferably, the bails 85 are pivotable relative to the torque head 40. As shown in FIG. 1, the top drive 50 has been lowered to a position proximate the rig floor 20, and the elevator 70 has been closed around the casing 30 resting on the rack 25. In this position, the casing 30 is ready to be hoisted by the top drive 50.

In another aspect, a tubular positioning device 100 is disposed on a platform 3 of the drilling rig 10. The tubular positioning device 100 may be used to guide and align the casing 30 with the casing string 65 for connection therewith. A suitable tubular positioning device 100 includes the pipe handling arm 100 shown in FIG. 1. The pipe handling arm 100 includes a gripping member 150 for engaging the casing 30 during operation. The pipe handling arm 100 is adapted and designed to move in a plane substantially parallel to the rig floor 20 to guide the casing 30 into alignment with the casing 65 in the spider 60.

FIGS. 4–5 depict a pipe handling arm 100 according to aspects of the present invention. FIG. 4 presents a top view of the pipe handling arm 100, while FIG. 5 presents a cross-sectional view of the pipe handling arm 100 along line A—A. The pipe handling arm 100 includes a base 105 at one end for attachment to the platform 3. The gripping member 150 is disposed at another end, or distal end, of the pipe handling arm 100. A rotor 110 is rotatably mounted on the base 105 and may be pivoted with respect to the base 105 by a piston and cylinder assembly 131. One end of the piston and cylinder assembly 131 is connected to the base 105, while the other end is attached to the rotor 110. In this manner, the rotor 110 may be pivoted relative to the base 105 on a plane substantially parallel to the rig floor 20 upon actuation of the piston and cylinder assembly 131.

A conveying member 120 interconnects the gripping member 150 to the rotor 110. In one embodiment, two support members 106, 107 extend upwardly from the rotor 110 and movably support the conveying member 120 on the base 105. Preferably, the conveying member 120 is coupled to the support members 106, 107 through a pivot pin 109 that allows the conveying member 120 to pivot from a position substantially perpendicular to the rig floor 20 to a position substantially parallel to the rig floor 20. Referring to FIG. 5, the conveying member 120 is shown as a telescopic arm. A second piston and cylinder assembly 132 is employed to pivot the telescopic arm 120 between the two positions. The second piston and cylinder assembly 132 movably couples the telescopic arm 120 to the rotor 110 such that actuation of the piston and cylinder assembly 132 raises or lowers the telescopic arm 120 relative to the rotor 110. In the substantially perpendicular position, the pipe handling arm 100 is in an unactuated position, while a substantially parallel position places the pipe handling arm 100 in the actuated position.

The telescopic arm 120 includes a first portion 121 slidably disposed in a second portion 122. A third piston and cylinder assembly 133 is operatively coupled to the first and second portions 121, 122 to extend or retract the first portion 121 relative to the second portion 122. In this respect, the telescopic arm 120 and the rotor 110 allow the pipe handling arm 100 to guide the casing 30 into alignment with the casing 65 in the spider 60 for connection therewith. Although a telescopic arm 120 is described herein, any suitable conveying member known to a person of ordinary skill in the art are equally applicable so long as it is capable of positioning the gripping member 150 at a desired position.

The gripping member 150, also known as the "head," is operatively connected to the distal end of the telescopic arm 120. The gripping member 150 defines a housing 151 movably coupled to two gripping arms 154, 155. Referring to FIG. 4, a gripping arm 154, 155 is disposed on each side of the housing 151 in a manner defining an opening 152 for retaining a casing 30. Piston and cylinder assemblies 134, 135 may be employed to actuate the gripping arms 154, 155. One or more centering members 164, 165 may be disposed on each gripping arm 154, 155 to facilitate centering of the casing 30 and rotation thereof. An exemplary centering member 164, 165 may include a roller. The rollers 164, 165 may include passive rollers or active rollers having a driving mechanism.

It is understood that the piston and cylinder assemblies 131, 132, 133, 134, and 135 may include any suitable fluid operated piston and cylinder assembly known to a person of ordinary skill in the art. Exemplary piston and cylinder assemblies include a hydraulically operated piston and cylinder assembly and a pneumatically operated piston and cylinder assembly.

In another aspect, the gripping member 150 may be equipped with a spinner 170 to rotate the casing 30 retained by the gripping member 150. As shown in FIG. 5, the spinner 170 is at least partially disposed housing 151. The spinner 170 includes one or more rotational members 171, 172 actuated by a motor 175. The torque generated by the motor 175 is transmitted to a gear assembly 178 to rotate the rotational members 171, 172. Because the rotational members 171, 172 are in frictional contact with the casing 30, the torque is transmitted to the casing 30, thereby causing rotation thereof. In one embodiment, two rotational members 171, 172 are employed and equidistantly positioned relative to a central axis of the gripping member 150. An exemplary rotational member 171 includes a roller. Rotation of the casing 30 will cause the partial make up of the connection between the casings 30, 65. It is understood that the operation may be reversed to break out a tubular connection.

In one aspect, the spinner 170 may be used to perform the initial make up of the threaded connection. The spinner 170 may include any suitable spinner known to a person of ordinary skill in the art. In one embodiment, the spinner 170 may be used to initially make up about 60% or less of a casing connection; preferably, about 70% or less; and most preferably, about 80% or less. In another embodiment, the spinner 170 may be used to initially make up about 70% or less of a drill pipe connection; preferably, about 80% or less; and most preferably, about 95% or less. One advantage of the spinner 170 is that it may rotate the casing 30 at a high speed or continuously rotate the casing 30 to make up the connection. In one embodiment, the spinner 170 may rotate the casing 30 relatively faster than existing top drives or power tongs. Preferably, the spinner 170 may rotate the casing 30 at a rate higher than about 5 rpm; more preferably, higher than about 10 rpm; and most preferably, higher than about 15 rpm. In another embodiment, the spinner 170 may accelerate faster than the top drive 50 or the power tong to rotate the casing 30.

A rotation counting member 180 may optionally be used to detect roller slip. Roller slip is the condition in which the rollers 171, 172 are rotating, but the casing 30 is not. Roller slip may occur when the torque supplied to the rollers 171, 172 cannot overcome the strain in the threaded connection required to further make up the connection. Roller slip may be an indication that the connection is ready for a power tong to complete the make up, or that the connection is damaged, for example, cross-threading. In one embodiment, the rotation counting member 180 includes a circular member 183 biased against the casing 30 by a biasing member 184. Preferably, the circular member 183 is an elastomeric wheel, and the biasing member 184 is a spring loaded lever.

A valve assembly 190 is mounted on the base 105 to regulate fluid flow to actuate the appropriate piston and cylinder assemblies 131, 132, 133, 134, 135 and motor 175. The valve assembly 190 may be controlled from a remote console (not shown) located on the rig floor 20. The remote console may include a joystick which is spring biased to a central, or neutral, position. Manipulation of the joystick causes the valve assembly 190 to direct the flow of fluid to the appropriate piston and cylinder assemblies. The pipe handling arm 100 may be designed to remain in the last operating position when the joystick is released.

In another aspect, the pipe handling arm 100 may include one or more sensors to detect the position of the gripping member 150. An exemplary pipe handling arm having such a sensor is disclosed in U.S. patent application Ser. No. 10/625,840, filed on Jul. 23, 2003, assigned to the same assignee of the present invention, which application is incorporated by reference herein in its entirety. In one embodiment, a linear transducer may be employed to provide a signal indicative of the respective extension of piston and cylinder assemblies 131, 133. The linear transducer may be any suitable liner transducer known to a person of ordinary skill in the art, for example, a linear transducer sold by Rota Engineering Limited of Bury, Manchester, England. The detected positions may be stored and recalled to facilitate the movement of the casing 30. Particularly, after the gripping member 150 has place the casing 30 into alignment, the position of the gripping member 150 may be determined and stored. Thereafter, the stored position may be recalled to facilitate the placement of additional casings into alignment with the casing string 65.

Figure 6:
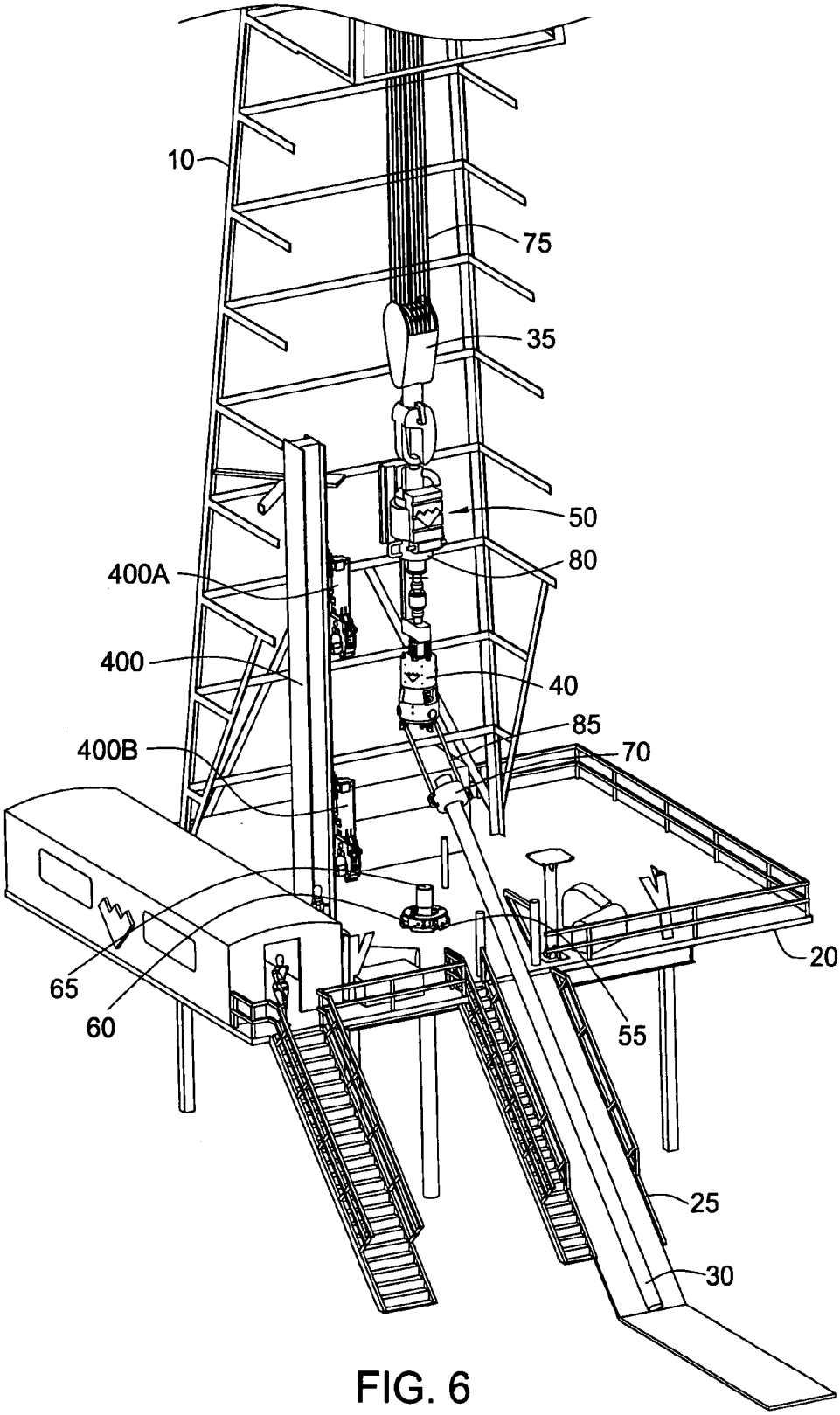
FIG. 6 is a partial view of another embodiment of a top drive system disposed on a rig according to aspects of the present invention.

In another embodiment, one or more pipe handling arms 100 may be disposed on a rail 400 as illustrated in FIG. 6. Similar parts shown in FIG. 1 are similarly designated in FIGS. 6–8. As shown in FIG. 6, the rail 400 is disposed on the rig floor 20 with two pipe handling arms 400A, 400B disposed thereon. The rail 400 allows axial movement of the pipe handling arms 400A, 400B, as necessary. The arms 400A, 400B are positioned such that, during operation, one arm 400A grips an upper portion of the casing 30 while the other arm 400B grips a lower portion of the casing 30. In this respect, the arms 400A, 400B may be manipulated to optimally position the casing 30 for connection with the casing string 65.

Figure 7:
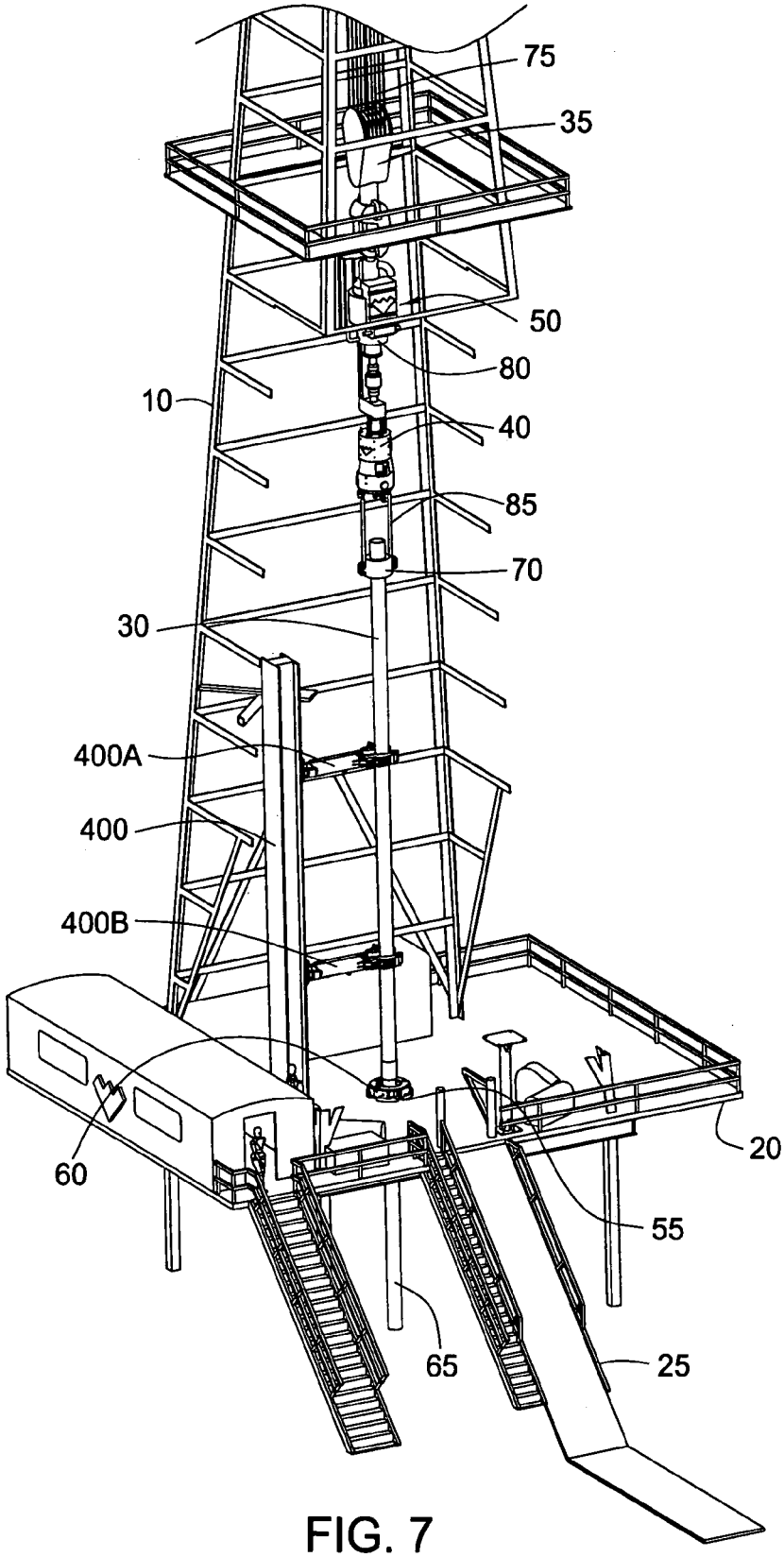
FIG. 7 is a partial view of the top drive system of FIG. 4 after the casing has been stabbed into the casing string.
Figure 8:
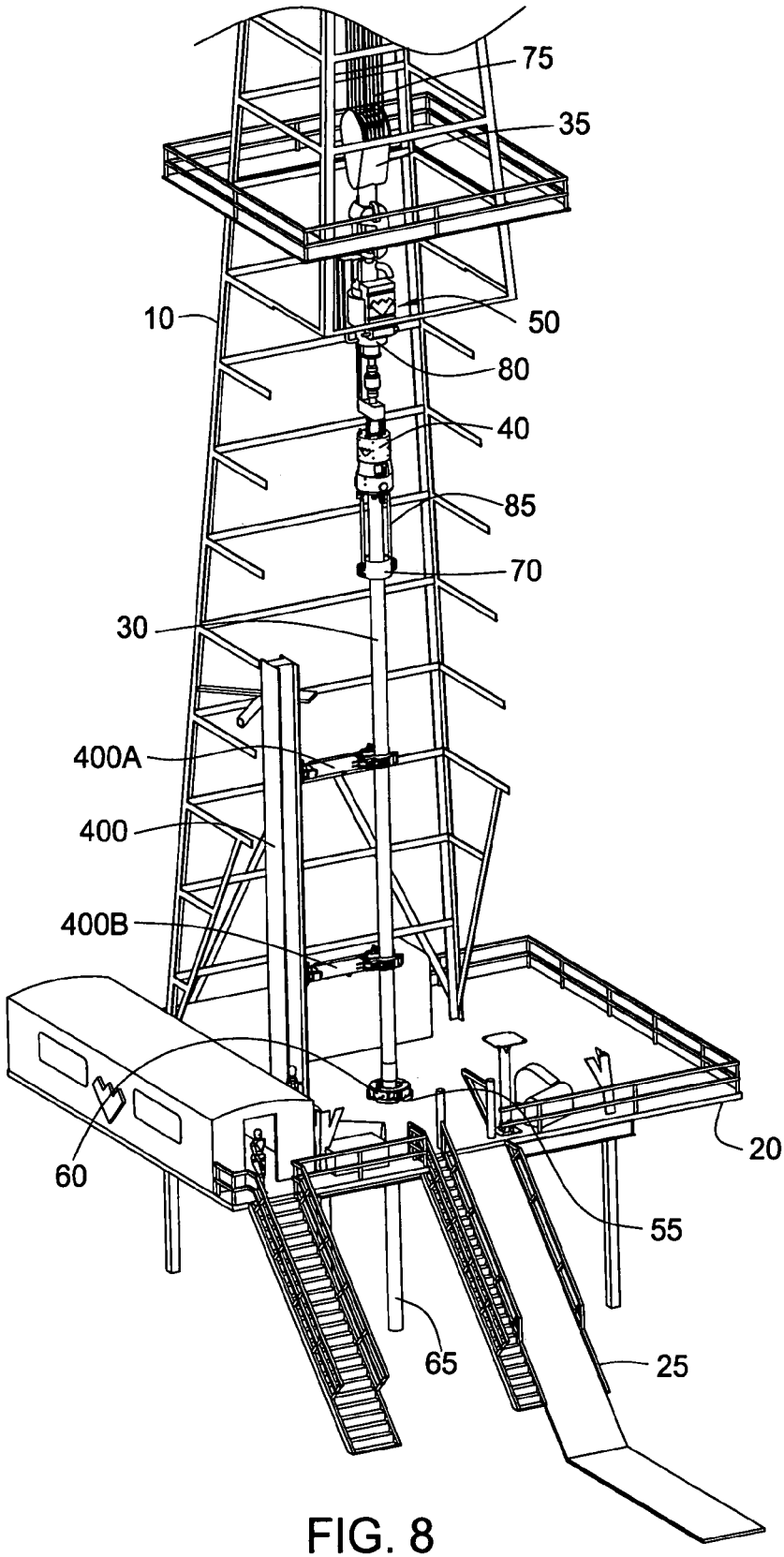
FIG. 8 is a partial view of the top drive system of FIG. 4 after the torque head has engaged the casing.

FIGS. 6–8 show the pipe handling arms 400A, 400B in operation. In FIG. 6, the casing string 65, which was previously drilled into the formation (not shown) to form the wellbore (not shown), is shown disposed within the hole 55 in the rig floor 20. The casing string 65 may include one or more joints or sections of casing threadedly connected to one another. The casing string 65 is shown engaged by the spider 60. The spider 60 supports the casing string 65 in the wellbore and prevents the axial and rotational movement of the casing string 65 relative to the rig floor 20. As shown, a threaded connection of the casing string 65, or the box, is accessible from the rig floor 20.

In FIG. 6, the top drive 50, the torque head 40, and the elevator 70 are shown positioned proximate the rig floor 20. The casing 30 may initially be disposed on the rack 25, which may include a pick up/lay down machine. The elevator 70 is shown engaging an upper portion of the casing 30 and ready to be hoisted by the cables 75 suspending the traveling block 35. The lower portion of the casing 30 includes a threaded connection, or the pin, which may mate with the box of the casing string 65. At this point, the pipe handling arms 400A, 400B are shown in the unactuated position, where the arms 400A, 400B are substantially perpendicular to the rig floor 20.

While the casing 30 is being lifted by the traveling block 35, the pipe handling arms 400A, 400B shift to the actuated position. The second piston and cylinder assembly 132 of each arm 400A, 400B may be actuated to move the respective telescopic arm 120 to a position parallel to the rig floor 20 as illustrated in FIG. 7. After the casing 30 is removed from the rack 25, it is placed into contact with at least one of the pipe handling arms 400A, 400B.

As shown, the casing 30 is positioned proximate the well center and engaged with arms 400A, 400B. The first arm 400A is shown engaged with an upper portion of the casing 30, while the second arm 400B is shown engaged with a lower portion of the casing 30. Particularly, the casing 30 is retained between gripping arms 154, 155 and in contact with rollers 164, 165, 171, 172. Each arm 400A, 400B may be individually manipulated to align the pin of the casing 30 to the box of the casing string 65. The arms 400A, 400B may be manipulated by actuating the first and third piston and cylinder assemblies 131, 133. Specifically, actuating the first piston and cylinder assembly 131 will move the gripping member 150 to the right or left with respect to the well center. Whereas actuating the third piston and cylinder assembly 133 will extend or retract the gripping member 150 with respect to the well center. In addition, the rotation counting member 180 is biased into contact with the casing 30 by the biasing member 184. After alignment, the pin is stabbed into the box by lowering the pin into contact with the box.

Thereafter, the spinner 170 is actuated to begin make up of the connection. Initially, torque from the motor 175 is transferred through the gear assembly 178 to the rotational members 171, 172. Because the rotational members 171, 172 are in frictional contact with the casing 30, the casing 30 is caused to rotate relative to the casing string 65, thereby initiating the threading of the connection. The rotation of the casing 30 causes the passive rollers 164, 165 to rotate, which facilitates the rotation of the casing 30 in the gripping member 150. At the same time, the rotation counting member 180 is also caused to rotate, thereby indicating that the connection is being made up. It is must noted that the casing 30 may be rotated by either one or both of the pipe handling arms 400A, 400B to make up the connection without deviating from the aspects of the present invention. In one embodiment, the arms 400A, 400B may move axially on the rail 400 for thread compensation during makeup. After the connection is sufficiently made up, the rotational members 171, 172 are deactuated. In this manner, the initial make up of the connection may be performed by the spinner 170 in a shorter time frame than either the top drive or power tong. Additionally, because the pipe handling arm 100 is supporting the casing 30, the load on threaded connection is reduced as it is made up, thereby decreasing the potential for damage to the threads.

Next, the torque head 40 is lowered relative to the casing 30 and positioned around the upper portion of the casing 30. The guide plate 290 facilitates the positioning of the casing 30 within the housing 205. Thereafter, the jaws 245 of the torque head 40 are actuated to engage the casing 30 as illustrated in FIG. 8. Particularly, fluid is supplied to the piston 251 and cylinder 250 assembly to extend the jaws 245 radially into contact with the casing 30. The biasing member 270 allows the inserts 260 and the casing 30 to move axially relative to the jaws 245. As a result, the coupling 32 seats above the shoulder 280 of the jaw 245. The axial load on the jaw 245 is then transmitted to the housing 205 through the jaw carrier 242. Because of the pivotable connection with the jaw 245, the piston 251 is protected from damage that may be cause by the axial load. After the torque head 40 engages the casing 30, the casing 30 is longitudinally and rotationally fixed with respect to the torque head 40. Optionally, a fill-up/circulating tool disposed in the torque head 40 may be inserted into the casing 30 to fill up and/or circulate fluid.

After the axial load is transferred to the torque head 40, the gripping arms 154, 155 of the pipe handling arms 400A, 400B are opened to release the casing 30. Thereafter, the pipe handling arms 400A, 400B are moved away from the well center by shifting back to the unactuated position. In this position, the top drive 50 may now be employed to complete the make up of the threaded connection. To this end, the top drive 50 may apply the necessary torque to rotate the casing 30 to complete the make up process. Initially, the torque is imparted to the torque head 40. The torque is then transferred from the torque head 40 to the jaws 245, thereby rotating the casing 30 relative to the casing string 65. It is envisioned that a power tong may also be used to complete the make up process. Furthermore, it is contemplated that a top drive may be used to perform the whole make up process.

Although the above operations are described in sequence, it must be noted that at least some of the operations may be performed in parallel without deviating from aspects of the present invention. For example, the torque head 40 may complete the make up process while the pipe handling arms 400A, 400B are shifting to deactuated position. In another example, the torque head 40 may be positioned proximate the upper portion of the casing 30 simultaneously with the rotation of the casing 30 by the spinner 170. As further example, while the spinner 170 is making up the connection, the power tong may be moved into position for connecting the casings 30, 65. By performing some of the operations in parallel, valuable rig time may be conserved.

After the casing 30 and the casing string 65 are connected, the drilling with casing operation may begin. Initially, the spider 60 is released from engagement with the casing string 65, thereby allowing the new casing string 30, 65 to move axially or rotationally in the wellbore. After the release, the casing string 30, 65 is supported by the top drive 50. The drill bit disposed at the lower end of the casing string 30, 65 is urged into the formation and rotated by the top drive 50.

When additional casings are necessary, the top drive 50 is deactuated to temporarily stop drilling. Then, the spider 60 is actuated again to engage and support the casing string 30, 65 in the wellbore. Thereafter, the gripping head 40 releases the casing 30 and is moved upward by the traveling block 35. Additional strings of casing may now be added to the casing string using the same process as described above. In this manner, aspects of the present invention provide methods and apparatus to facilitate the connection of two tubulars.

After a desired length of wellbore has been formed, a cementing operation may be performed to install the casing string 30, 65 in the wellbore. In one embodiment, the drill bit disposed at the lower end of the casing string 30, 65 may be retrieved prior to cementing. In another embodiment, the drill bit may be drilled out along with the excess cement after the cement has cured.

In another aspect, the pipe handling arm 100 may be mounted on a spring loaded base 105. Generally, as the threaded connection is made up, the casing 30 will move axially relative to the casing string 65 to accommodate the mating action of the threads. The spring loaded base 105 allows the pipe handling arm 100 to move axially with the casing 30 to compensate for the mating action. In another embodiment, the pipe handling arm 100 may move axially along the rail 400 to compensate for the mating action.

In another aspect, the pipe handling arms 100 may be used to move a casing 30 standing on a pipe racking board on the rig floor 20 to the well center for connection with the casing string 65. In one embodiment, the arms 400A, 400B on the rail 400 may be manipulated to pick up a casing 30 standing on the rig floor 20 and place it above well center. After aligning the casings 30, 65, the pipe handling arms 400A, 400B may stab the casing 30 into the casing string 65. Then, the spinner 170 may be actuated to perform the initial make up. When the connection is ready for final make up, the torque head 40 is lowered into engagement with the casing 30. Thereafter, the top drive 50 may cause the torque head 40 to rotate the casing 50 to complete the make up process. It is envisioned that the pipe handling arms 400A and 400B may retain the casing 30 while it is being made up by the top drive 50. In this respect, the rollers 164, 165, 171, 172 act as passive rollers, thereby facilitating rotation of the casing 30.

It is contemplated that aspects of the present invention are equally applicable to breaking out or removal of wellbore tubulars from the well. Moreover, in addition to casing, aspects of the present invention may also be used to handle drill pipe, tubing, or other types of wellbore tubulars as is known to a person of ordinary skill in the art. Furthermore, the wellbore tubulars may comprise flush joint tubulars as well as tubulars having a coupling.

Figure 10:
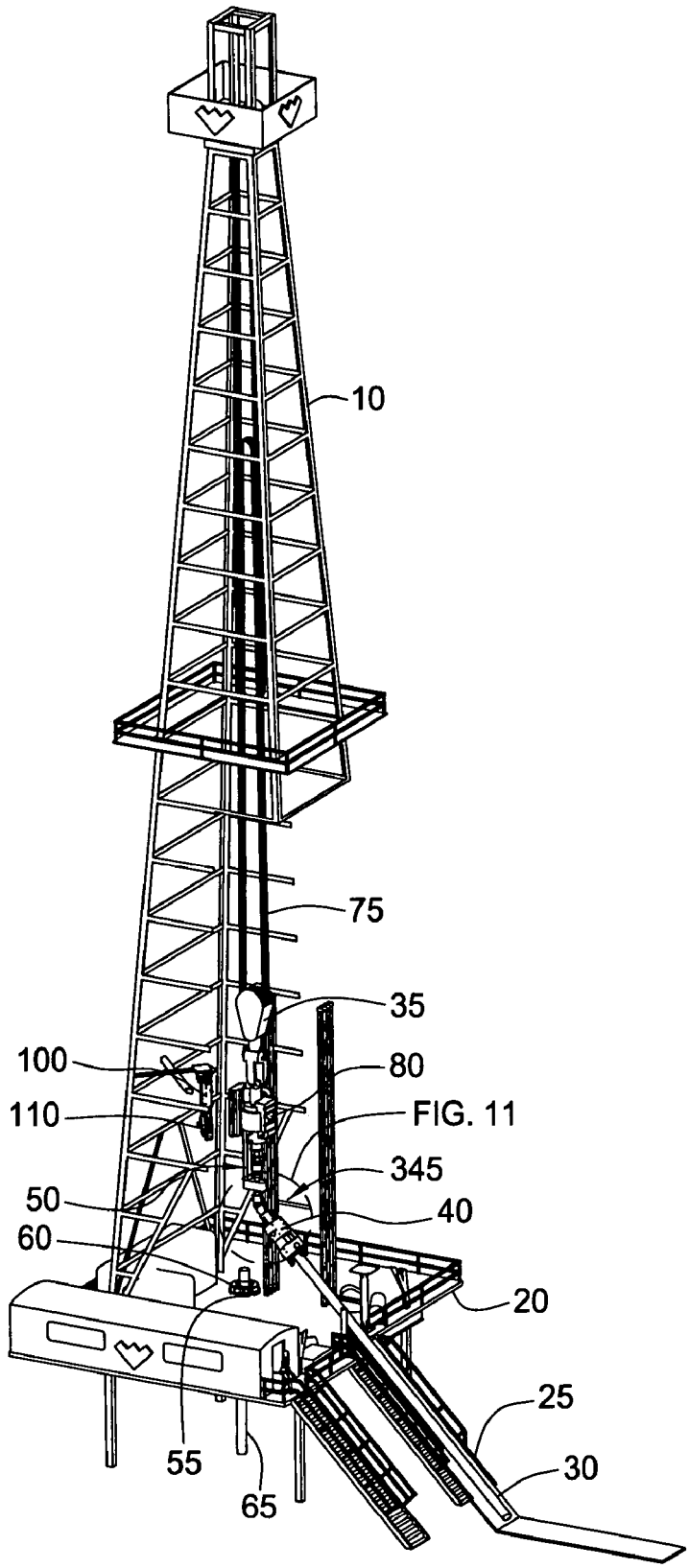
FIG. 10 is a sectional view of the apparatus of FIG. 9 retrieving a casing string from a rack through a v-door of a drilling rig.
Figure 11:
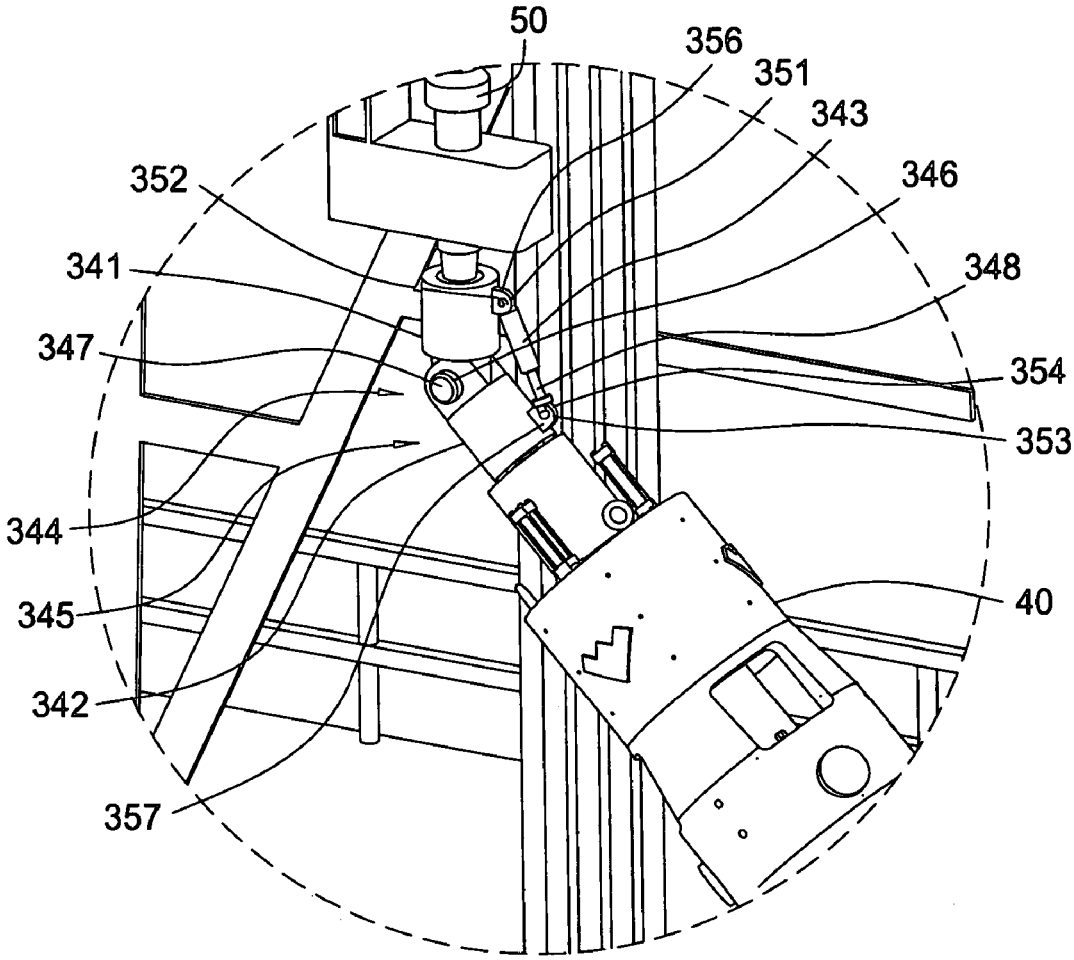
FIG. 11 is a section view of a pivotable mechanism of the apparatus shown in FIG. 10.

In another aspect, a pivotable mechanism 345 may be disposed between the top drive 50 and the torque head 40 to facilitate transport of the casing 30 to the well center. As shown in FIG. 10, the pivotable mechanism 345 is disposed below the top drive 50. Particularly, female threads at a lower end of the top drive 50 mate with male threads at an upper end of the pivotable mechanism 345. FIG. 11 shows an embodiment of the pivotable mechanism 345 having an upper member 341 and an articulating arm 342. The upper member 341 of the pivotable mechanism 345 is tubular-shaped with a longitudinal bore therethrough. The upper member 341 has protruding members 346 such as bolts connected to its outer diameter at its lower end and extending outward from its outer diameter, so that the protruding members 346 are opposite one another across the upper member 341.

The articulating arm 342 of the pivotable mechanism 345 is also tubular-shaped with a longitudinal bore therethrough. In the preferred embodiment, the bore of the articulating arm 342 and the bore of the upper member 341 are capable of fluid communication. The articulating arm 342 has holes 347 therein disposed at its upper end which mate with the protruding members 346 of the upper member 341. The holes 347 and the protruding members 346 combine to form a swivel joint 344 which pivotally connects the upper member 341 to the articulating arm 342. Any other type of swivel joint 344 which allows the articulating arm 342 to articulate relative to the upper member 341 may also be used with the present invention.

The swivel joint 344 is pivoted by a piston 348 disposed within a cylinder 343. The cylinder 343 possesses bolts 352 extending from its outer diameter at its upper end. The bolts 352 are disposed opposite from one another across the cylinder 343. The upper member 341 has an upper member extension 356, which is a portion of the upper member 341 which protrudes outward from an upper portion of an outer diameter of the upper member 341. The upper member extension 356 has holes 351 extending therethrough which mate with the bolts 352 of the cylinder 343, so that the cylinder 343 is pivotable relative to the upper member 341. Any other pivotable connection between the cylinder 343 and the upper member 341 is also suitable for use with the present invention.

The piston 348 is located within the cylinder 343 and moveable inward and outward from the cylinder 343. The piston 348 has bolts 354 extending from its outer diameter at its lower end opposite from one another across the piston 348. The articulating arm 342 includes an articulating arm extension 357, which is a portion of the articulating arm 342 which extends outward from the articulating arm 342 at a lower portion of the articulating arm 342. When the articulating arm 342 and the upper member 341 are in line with one another as in FIG. 1, the articulating arm extension 357 is parallel to the upper member extension 356 so that the piston 348, cylinder 343, articulating arm extension 357, and upper member extension 356 are coaxial with one another and are all located within the same plane. The articulating arm extension 357 has holes 353 therethrough which mate with the bolts 354 so that the piston 348 is pivotable with respect to the articulating arm extension 357. The piston 348 is preferably expanded or contracted relative to the cylinder 343 by hydraulic or pneumatic fluid provided to the cylinder 343 behind the piston 348 manually or remotely. Any other method of expanding or retracting the piston 348 within the cylinder 343 known by those skilled in the art is suitable for use with the present invention.

Referring to FIGS. 9–13, the lower end of the articulating arm 342 may be connected to an upper end of a top drive adapter. The pivotable mechanism 345 serves as a structural intermediate between the top drive 50 and the top drive adapter. As shown in FIG. 11, the top drive adapter is a torque head. However, other types of top drive adapters such as a spear may connect to the pivotable mechanism. Preferably, male threads located on the upper end of the gripping head 40 unite with female threads located at the lower end of the articulating arm 342 of the pivotable mechanism 345. The pivotable mechanism 345 allows the torque head 40 to grip an upper portion of the casing 30 from a rack 25 or a pickup/lay down machine and transports the casing 30 to the well center. Alternatively, the torque head 40 may be used to grip and transport the casing 30 from any location away from well center to well center. Similarly, the torque head may be used to grip and transport the casing 30 from any location away from the rotational axis of the top drive 50 to the same rotational axis occupied by the top drive 50. The torque head may also be used to disconnect or remove tubulars from the well center.

FIGS. 14–17 show an alternate embodiment of the present invention. The same components in FIGS. 14–17 as in FIGS. 9–13 are designated with like numbers. A telescopic link system 390 may be utilized with the torque head 40 and the pivotable mechanism 345 to extend outward from the torque head 40 to move the casing 30 from the rack 25, through the v-door, and toward the torque head 40. An upper end of the telescopic link system 390 is connected to a lower end of the torque head 40.

Figure 16:
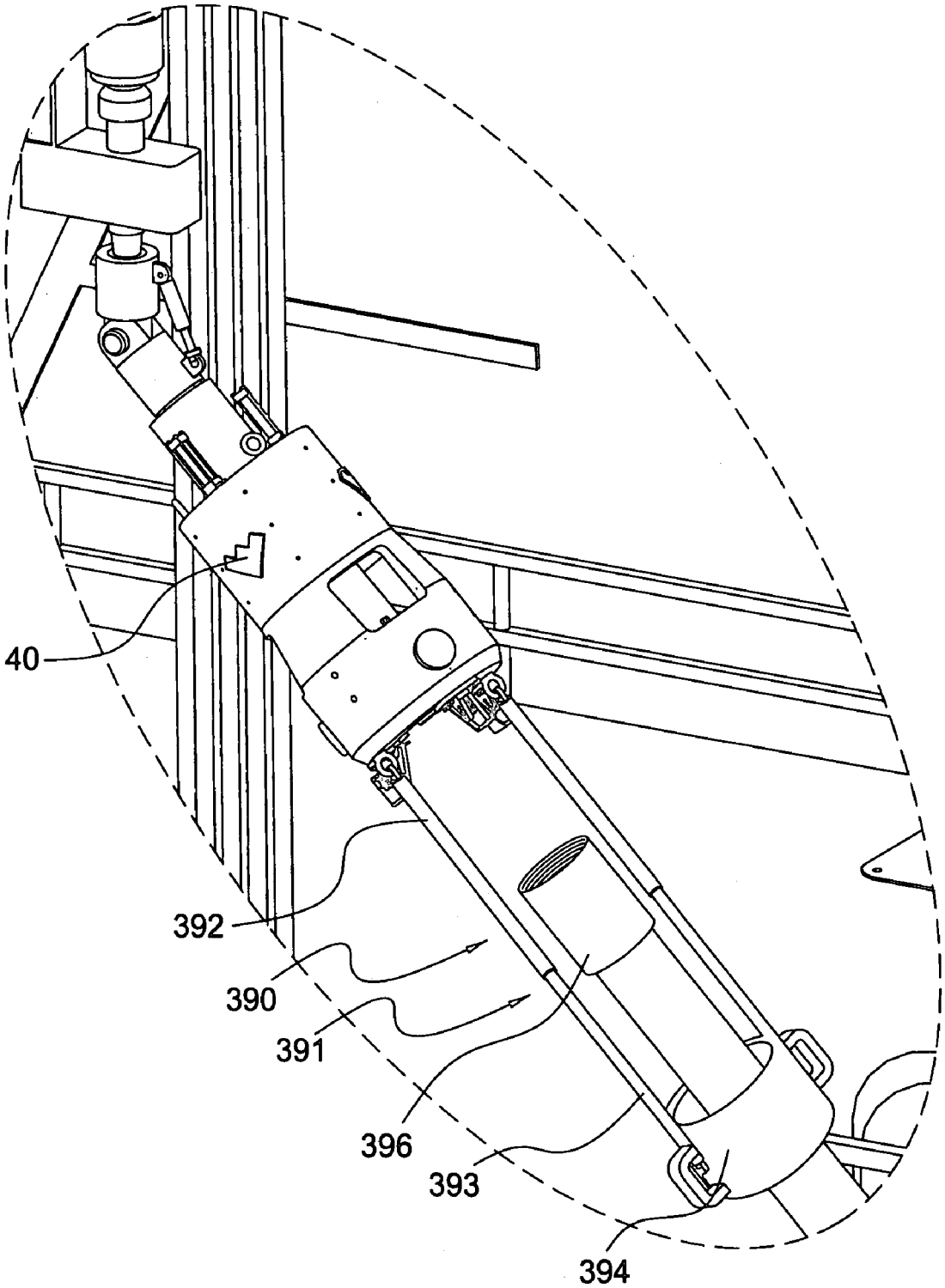
FIG. 16 is a section view of a pivotable mechanism, gripping head, and telescopic link system of the apparatus shown in FIG. 15.

As shown in FIG. 16, the telescopic link system 390 includes telescopic links 391 which have tubular-shaped cylinders 392 with bores therethrough rigidly connected to opposite walls of the torque head 40, as well as tubular-shaped pistons 393 located in the same planes as the cylinders 392. The pistons 393 are located within the cylinders 392 and are moveable through the bores of the cylinders 392 towards and away from the torque head 40. The pistons 393 are preferably expanded or retracted relative to the cylinders 392 by providing hydraulic pressure to the cylinders 392 behind the pistons 393 manually or remotely.

Any other method of expanding or retracting the pistons 393 within the cylinders 392 known by those skilled in the art is suitable for use with the present invention.

Connected to a lower end of the pistons 393 is a tubular retaining apparatus 394. The tubular retaining apparatus 394 has a bore therethrough with gripping members or slips (not shown) located on an inner wall of the tubular retaining apparatus 394. The tubular retaining apparatus 394 may be a single joint elevator. In one embodiment, the tubular retaining apparatus 394 may include two body portions hingedly connected to each other. In this respect, the tubular retaining apparatus 394 may be opened to receive the casing 30 in the bore. Preferably, the tubular retaining apparatus 394 may be opened and closed at either hinge connection. When the gripping members are unactivated, the casing 30 is moveable through the tubular retaining apparatus 394; however, when the gripping members are activated, the tubular retaining apparatus 394 grippingly engages the casing 30. Typically, the gripping members move inward along the inner wall of the tubular retaining apparatus 394 to grip the outer diameter of the casing 30 below a coupling 396. The coupling 396 is a hollow, tubular-shaped device with female threads located therein, and is located at one end of the casing 30. The coupling 396 is adapted to engage the male threads of an adjacent casing, thereby forming the extended casing string. For example, the male threads of the casing 30 may be inserted or connected to the female threads in the coupling of the casing string 65. Furthermore, the coupling 396 serves as a shoulder below which the tubular retaining apparatus 394 may be located to help hoist the casing 30 upward towards the torque head 40. In another embodiment, the tubular retaining apparatus 394 is not equipped with gripping members. Instead, the tubular retaining apparatus 394 includes a shoulder disposed in the bore adapted to support the shoulder of the coupling 396 on the casing 30.

Other types of tubular transport apparatus for transport the tubular to the top drive adapter are within the scope of the present invention. In one aspect, the tubular transport apparatus may comprise a motor capable of retrieving an extension member such as a cable or chain secured to the tubular retaining apparatus 394. In one embodiment, the tubular transport apparatus may comprise a winch and a one or more cables coupled to the winch at one end and the tubular retaining apparatus at another end.

Figure 17:
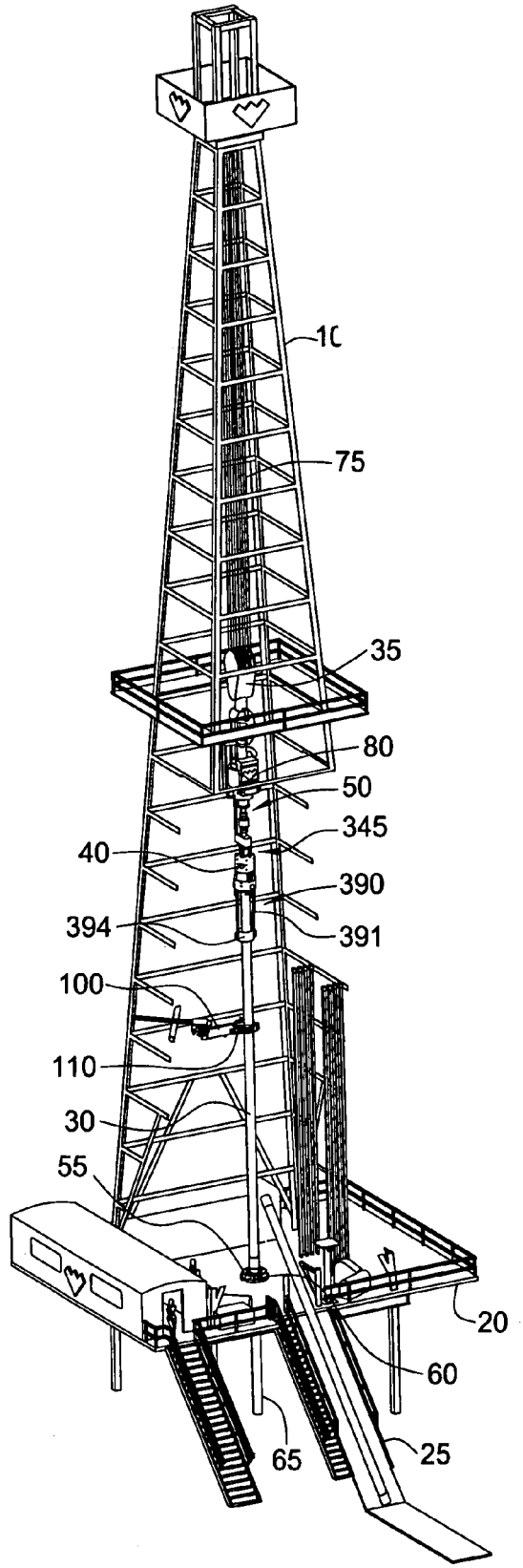
FIG. 17 is a sectional view of the apparatus of FIG. 14 positioning the casing string over well center.
Figure 18:
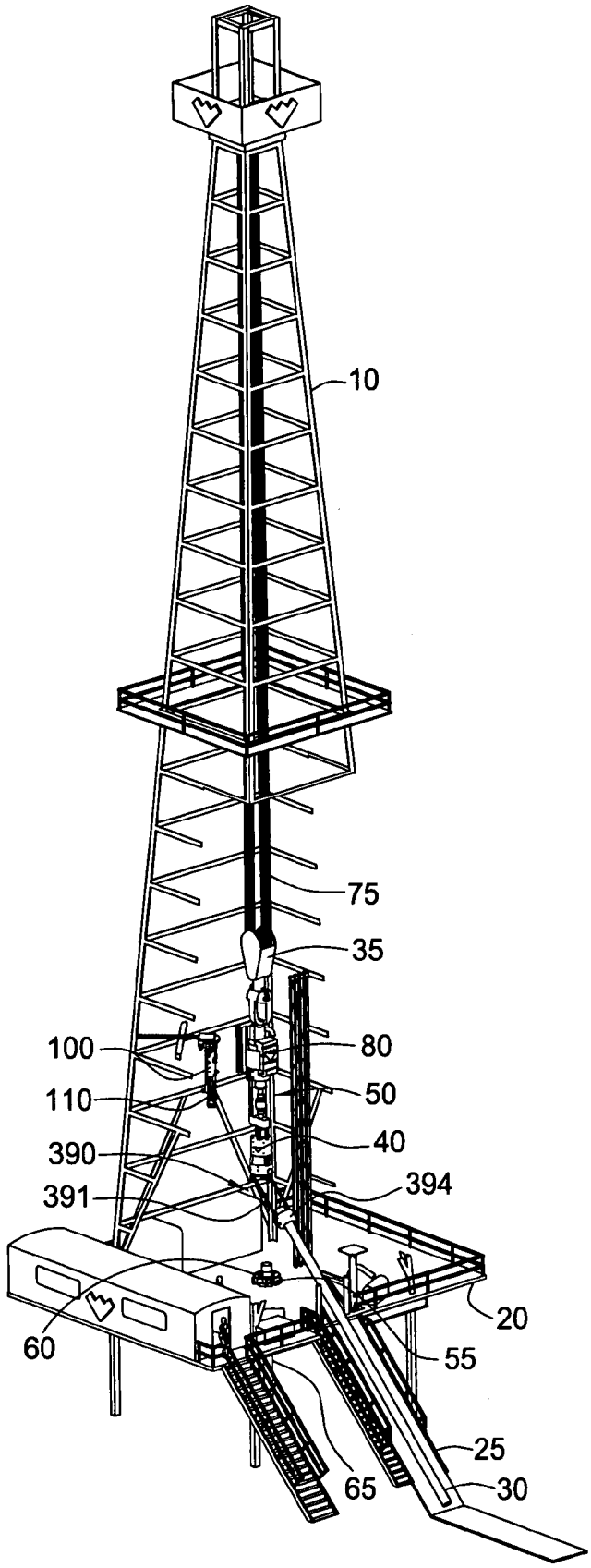
FIG. 18 is a sectional view of a further alternate embodiment of the apparatus of the present invention retrieving a casing string from a rack through a v-door of a drilling rig.

FIG. 18 shows a further alternate embodiment of the present invention. In this embodiment, rather than the pivotable mechanism 345 pivoting from the well center to pick up the casing 30 and the telescopic links 391 being rigidly connected to the torque head as shown in FIGS. 14–17, the telescopic links 391 are pivotable with respect to the torque head 40. The upper ends of the telescopic links 391 are pivotally connected to a lower end of the torque head 40. Any pivotable connection is possible for use with the telescopic links 391, including but not limited to providing a hook around which the cylinders 392 may attach and swivel to pick up the casing 30. The telescopic links 391 of the embodiment shown in FIG. 18 telescope in the same manner as the telescopic links 391 of FIGS. 14–17.

Figure 9:
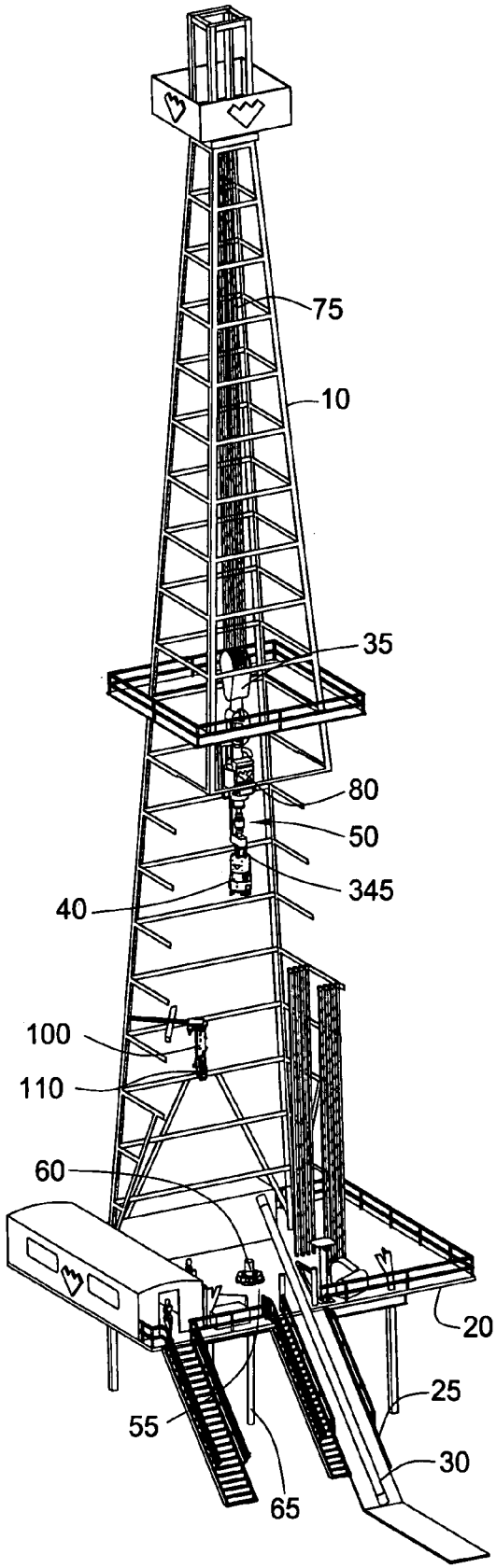
FIG. 9 is a sectional view of the apparatus of the present invention in an unactuated position suspended above the rig floor.

The operation of the first embodiment is shown in FIGS. 9–13. In FIG. 9, the casing string 65 which was previously drilled into the formation (not shown) to form the wellbore (not shown) is shown disposed within the hole 55 in the rig floor 20. The casing string 65 may include one or more joints or sections of casing threadedly connected to one another. Operatively connected at a lower end of the casing string 65 is an earth removal member, such as a drill bit (not shown), which is used to drill through the formation to form the wellbore. The casing string 65 is hindered from downward movement into the wellbore by the spider 60, as the gripping members or slips of the spider 60 are engaged around the outer diameter of the casing string 65. The casing string 65 is also rotationally fixed relative to the rig floor 20 by the spider 60.

Initially, the traveling block 35, top drive 50, pivotable mechanism 345, and torque head 40 are located substantially coaxially with and in the same plane as the well center. The casing 30 is disposed on the rack 25, which may comprise a pick up/lay down machine. The pipe handling arm 100 is shown unactuated, where the clamp head 110 is parallel to the well center. In this position, fluid communication exists through a sealed path from the top drive 50 all the way down through the torque head 40. The piston 348 is extended from the cylinder 343 by fluid pressure behind the piston 348. The extended position causes the torque head 40 to exist coaxially with well center.

In the first step of the operation, the wires 75 around the draw works (not shown) move the assembly including the traveling block 35, top drive 50, pivotable mechanism 345, and torque head 40 downward towards the rig floor 20 substantially coaxially with the well center. The top drive 50 is located on the railing system (not shown) so that the top drive 50 is only moveable upward and downward substantially coaxially with well center and is not moveable radially outward from the well center.

FIGS. 10 and 11 illustrate the next step in the process, which involves the activation of the pivotable mechanism 345. When the assembly is lowered to the desired level above the rig floor 20 at which to obtain the casing 30 from the rack 25, fluid flow behind the piston 348 is halted so that the piston 348 retracts into within the cylinder 343. When the piston 348 retracts within the cylinder 343, the articulating arm 342 is forced to pivot away from the well center and away from the upper member 341 by the holes 347 rotating around the protruding members 346. The articulating arm extension 357 swivels upward and toward the upper member 341, thus moving away from coaxial alignment with the upper member 341 and the upper member extension 356.

Because the torque head 40 is threadedly connected to the articulating arm 342, the torque head 40 pivots along with the articulating arm 342 away from the axial line which the rest of the apparatus occupies. The torque head 40 is then positioned around the outer diameter of the casing 30, and the retaining members of the torque head 40 are activated to grippingly engage the casing 30 and fix the casing 30 longitudinally and rotationally with respect to the torque head 40. The retaining members must also act as a hydraulic seal between the casing 30 and the torque head 40 so that fluid introduced into the torque head 40 exits at a lower end of the casing 30. As mentioned above, the torque head 40 may also sealingly and grippingly engage the inner diameter of the casing 30, as is the function of a spear, for example. FIG. 10 shows the pivotable mechanism 345 tilting the torque head 40, and the activated torque head 40 engaging the casing 30.

The cables 75 of the draw works are then manipulated to cause the top drive 50 to move upward away from the rig floor 20 along the railing system. Upward movement of the top drive 50 causes the pivotable mechanism 345 and, therefore, the torque head 40 to move upward. The torque head 40 pulls the casing 30 upward along with it. The assembly is at least moved upward enough so that a portion of the casing 30 is located across from the pipe handling arm 100.

Next, fluid is introduced behind the piston 348. The hydraulic pressure from fluid flowing into the cylinder 343 forces the piston 348 to extend from the cylinder 343. The piston 348 expands to pivot the articulating arm 342 back toward the well center, as the articulating arm 342 swivels around the swivel joint 344. The piston 348 continues to extend until the torque head 40, pivotable mechanism 345, and the top drive 50 are all located substantially in line with one another and substantially in line with the well center.

The pivotable mechanism 345 may be utilized to control the rate at which the casing 30 is moved from the rack 25 to well center. The amount or force of the fluid introduced behind the piston 348 directly affects the rate at which the casing 30 pivots toward well center. Therefore, the angle of the casing 30 with respect to well center decreases with increasing pressure or force behind the piston 348. The pivotable mechanism 345 may be used to tail in the casing 30 to control the angle at which the casing 30 exists with respect to well center over time. Preferably, the angle at which the casing 30 exists when initially grippingly engaged by the torque head 40 is between about one degree and about 345 degrees, and preferably the pivotable mechanism 345 is controlled so that the casing 30 progresses toward well center at between approximately one degree per second and approximately 10 degrees per second. Therefore, the pivoting mechanism 345 advantageously provides a method of moving the casing 30 toward the well center without using an operator to guide the casing 30, thereby reducing the hazards related to handling wellbore tubulars.

Figure 12:
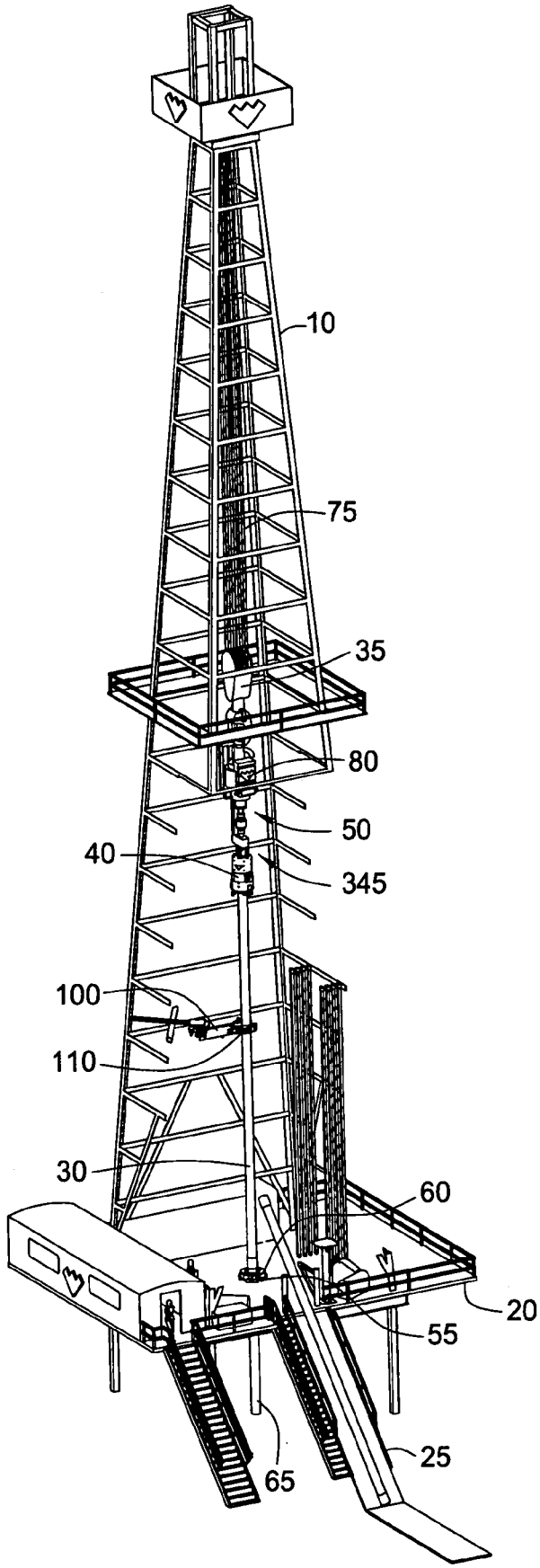
FIG. 12 is a sectional view of the apparatus of FIG. 9 positioning the casing string over well center.

The pipe handling arm 100 is then pivoted upward and toward the casing 30 while the clamp head 110 is in an open position so that gripping arms (not shown) of the clamp head 110 are open. Once the clamp head 110 is positioned around the casing 30, the gripping arms of the clamp head 110 are closed around the casing 30. The pipe handling arm 100 aids in maintaining the casing 30 in line with well center to guide the casing 30 during the make up operation. The casing 30 is then lowered downward toward the casing string 65 already existing in the wellbore. Thereafter, the casing 30 is rotated by the motor 80 of the top drive 50 to threadedly connect the casing 30 to the casing strings 65. The casing 30 may be lowered during make-up to compensate for the movement of the casing 30 during make-up. FIG. 12 illustrates the casing 30 positioned over well center after the threaded connection is made up by the top drive 50.

Figure 13:
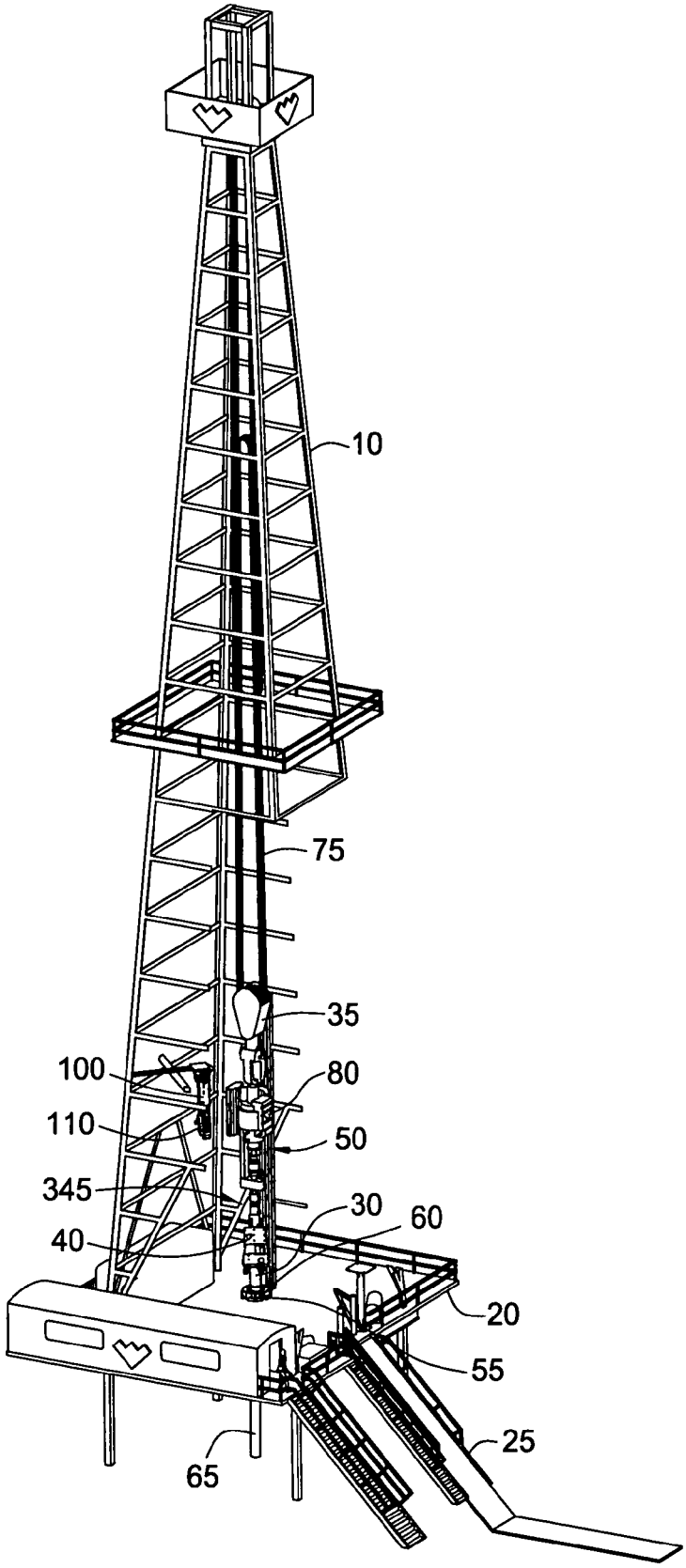
FIG. 13 is a sectional view of the apparatus of FIG. 9, where the casing string has been lowered into the wellbore.

After the casing 30 and the casing string 65 are connected to one another, the drilling with casing operation may begin. The spider 60 is released from gripping engagement with the outer diameter of the casing string 65, so that the casing string 65 is axially moveable into the formation. The casing string 30, 65 is urged downward by the draw works and rotated by the top drive 50, which imparts torque to the pivoting mechanism 345, the torque head 40, and the casing string 30, 65. The pivoting mechanism 345, torque head 40, and casing string 30, 65 (or, alternatively, the earth removal member operatively connected to the casing string 65), rotate relative to the top drive 50 and the portion of the assembly above the top drive 50 due to a swivel joint (not shown) located between the top drive 50 and the pivoting mechanism 345. The earth removal member (not shown) located on the lower end of the casing string 65 drills further into the formation to form a wellbore of a second depth. While drilling with the casing string 30, 65, drilling circulation fluid under pressure is introduced into the assembly to prevent the inner diameter of the casing string 30, 65 from filling up with mud and other wellbore fluids. The torque head 40 may be equipped with a circulation tool to perform such a task. The sealable engagement of and the bores running through the top drive 50, pivotable mechanism 345, torque head 40, and casing string 30, 65 allow fluid to circulate through the inner diameter of the casing string 30, 65 and up through the annular space between the casing string 30, 65 and the formation. FIG. 13 shows the casing string 30, 65 lowered into the wellbore, where the casing string 30, 65 has been drilled to the desired depth within the formation.

Once the casing string 30, 65 is drilled to the desired depth within the formation, the spider 60 is then actuated again to grippingly engage an upper portion of the casing 30. Necessarily, the casing string 30, 65 may only be drilled to a depth at which a portion of the casing string 30 remains above the rig floor 20; otherwise, there is nothing for the spider 60 to grip to prevent the casing string 30, 65 from further axial movement downward into the formation. After the spider 60 is actuated to grip the casing string 30, the gripping members of the torque head 40 are released and the assembly is moved upward relative to the rig floor 20 and the casing string 30, 65 disposed therein.

During operation, to ensure that the casing 30 is grippingly engaged by at least one of the torque head 40, tubular retaining apparatus 394 (see FIGS. 14–18), or spider 60 at all times so that the casing 30 is not inadvertently dropped, an interlock system (not shown) for the top drive 50 and the spider 60 may be utilized with the present invention. A suitable interlock system is described in U.S. patent application Ser. No. 09/860,127 filed on May 17, 2001, which was above incorporated by reference. The interlock system may include a controller (not shown) having a sensor processing unit (not shown) which may be employed to prevent release of the slip members of the spider 60, torque head 40, and/or tubular retaining apparatus 394 until another gripping mechanism grippingly engages the casing 30. The controller is capable of receiving data from sensors and other devices and capable of controlling devices to which it is connected. A sensor (not shown) is located at the spider 60, and another sensor (not shown) is located at or near the top drive 50 or other tubular retaining apparatus 394 for relaying information to the controller.

Subsequent to the assembly moving upward relative to the rig floor 20, the pipe handling arm 100 is pivoted downward towards the rig floor 20 and radially outward with respect to well center. After the casing 30 is placed within the wellbore, additional strings of casing may be placed into the formation using the same process as described above in relation to casing 30.

Figure 14:
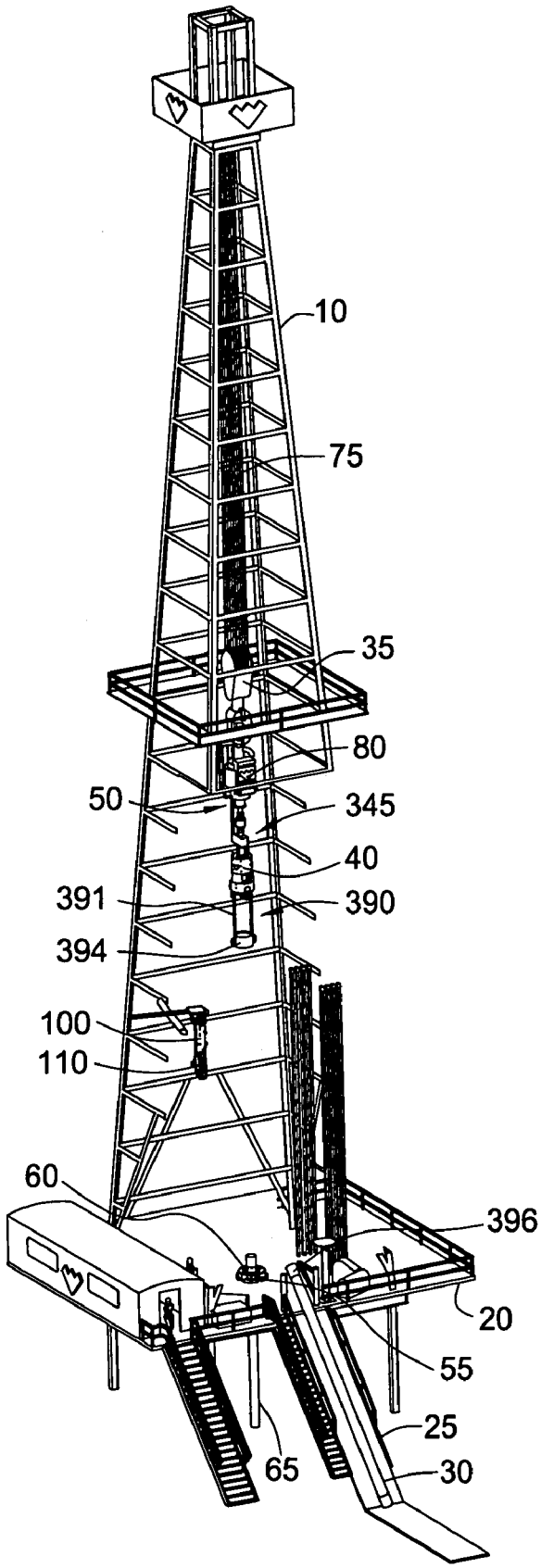
FIG. 14 is a sectional view of an alternate embodiment of the apparatus of the present invention. The apparatus is shown in an unactuated position suspended above the rig floor.

In the operation of the alternate embodiment shown in FIGS. 14–17, the telescopic link system 390 is activated to obtain the casing 30 from the rack 25. FIG. 14 shows the initial position of the assembly, where the pivotable mechanism 345 as well as the telescopic link system 390 is unactuated. The telescopic link system 390 is in the retracted position, where the pistons 393 reside within the cylinders 392, because no fluid is forcing the pistons 393 out of the cylinders 392. The spider 60 is grippingly engaging the casing string 65, which was previously drilled into the formation to form the wellbore. The casing string 65 was used to drill the wellbore using the torque generated by the top drive 50 and using the earth removal member (not shown) connected to its lower end.

In the next step of the drilling with casing operation, the assembly is lowered toward the rig floor 20 by the draw works. The pivotable mechanism 345 is pivoted as described above in relation to FIGS. 9–14, so that the torque head 40 and the telescopic link system 390 are therefore pivoted accordingly with respect to the well center towards the casing 30 on the rack 25. Fluid is introduced into the cylinders 392 behind the pistons 393, so that pressurized fluid forces the pistons 393 outward from the cylinders 392 toward the casing 30. The telescopic link system 390 telescopes radially outward with respect to the well center to retrieve the casing 30. To this end, the casing 30 is placed through the tubular retaining apparatus 394 of the telescopic link system 390.

Figure 15:
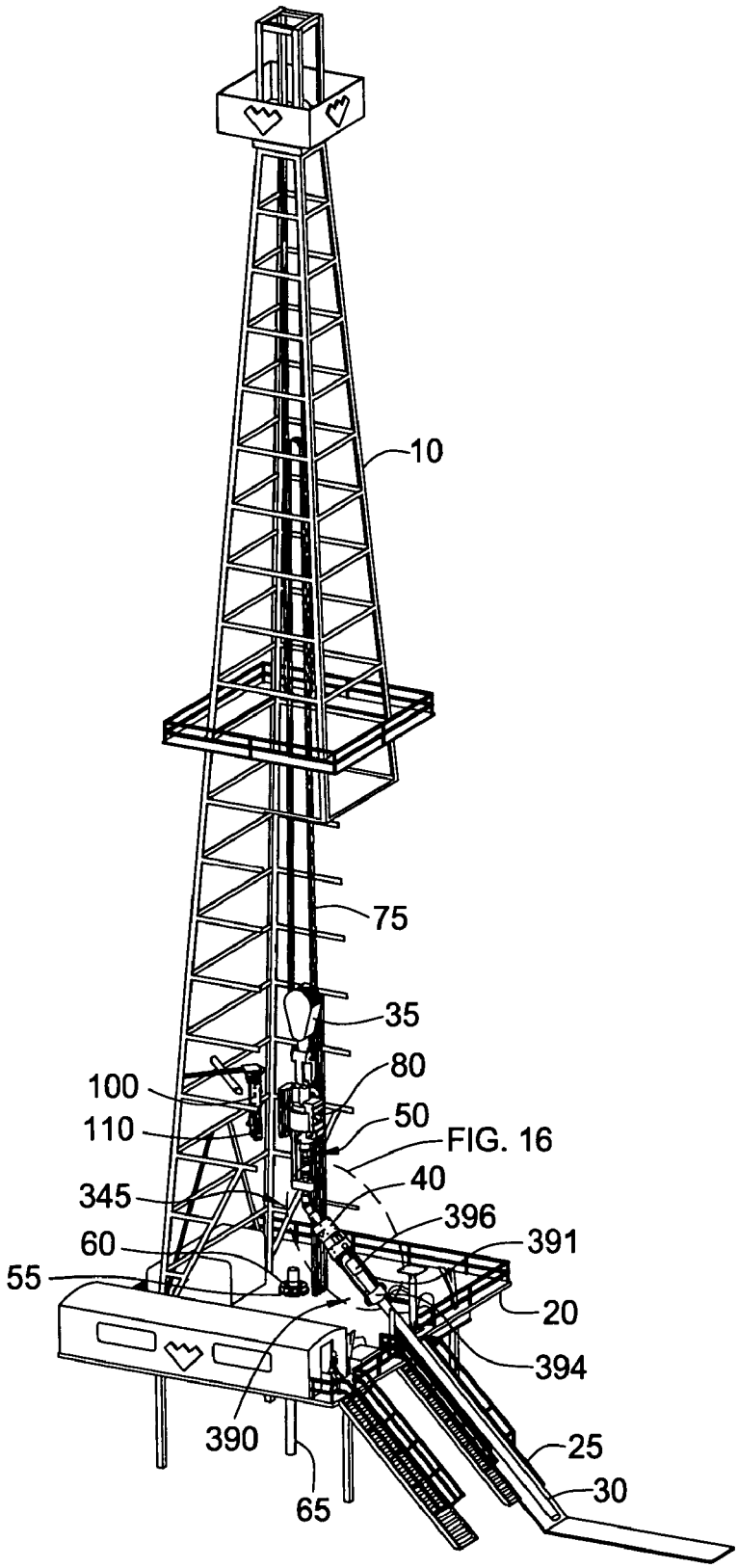
FIG. 15 is a sectional view of the apparatus of FIG. 14 retrieving a casing string from a rack through a v-door of a drilling rig.

The gripping members (not shown) of the tubular retaining apparatus 394 are actuated to grippingly engage the outer diameter of the casing 30 below the coupling 396. FIGS. 15–16 illustrate the telescopic links 391 extended to retrieve the casing 30 and the tubular retaining apparatus 394 gripping the casing 30 so that the casing 30 is axially and rotationally fixed relative to the telescopic link system 390.

Next, the pressurized fluid introduced into the cylinders 392 is halted so that the pistons 393 retreat back into the cylinders 392. At this point, the telescopic links 391 move to the retracted position and pull the casing 30 from the rack 25, through the v-door, and toward the torque head 40. The telescopic link system 390 with the casing 30 attached thereto as well as the torque head 40 is then pivoted back to the well center by the pivotable mechanism 345 as described above in relation to FIGS. 9–14. The pipe handling arm 100 is engaged around the casing 30 as in FIGS. 9–14. Next, the casing 30 is lowered so that a lower end of the casing 30 rests upon the upper end of the casing string 65, and the top drive 50 is utilized to torque the threadable connection between the casing strings 30 and 65.

The gripping members of the tubular retaining apparatus 394 are released, and the torque head 40 is rendered moveable axially in relation to the casing 30. At the same time, the casing 30 is prevented from falling into the wellbore due to the threadable connection between casing 30 and casing string 65. FIG. 17 shows the casing 30 swiveled to exist in substantially the same line as the well center and the casing strings 30, 65 threadedly connected. The torque head 40 is then moved downward toward the casing 30 so that the outer diameter of the casing 30 is located within the inner diameter of the torque head 40, and then the gripping members (not shown) of the torque head 40 are actuated to grippingly and sealingly engage the upper end of the casing 30. Again, an alternate torque head such as a spear may grippingly engage the inner diameter of the casing 30. FIG. 17 depicts the position of the torque head 40 and the casing 30 above the wellbore, with the torque head 40 engaging the casing 30.

The description above for FIGS. 9–14 relating to the releasing the spider 60 from the casing string 65 and drilling with the casing string 30, 65 applies equally to the embodiment of FIGS. 14–17. After the spider 60 is released from the casing string 65, the top drive 50 is then activated to provide rotational force to drill the casing string 30, 65 with the cutting apparatus located at the lower end of the casing string 65 into the formation. The sealing engagement of the torque head 40 to the casing 30 provides a fluid path for the circulation fluids utilized during the drilling with casing operation. Once the casing string 30, 65 has been drilled to the desired depth, the spider 60 is actuated again to grip the outer diameter of an upper portion of the casing 30, the torque head 40 is unactuated, and the process is repeated to drill additional casing strings into the formation. The interlock system (not shown) described above may also be utilized with this embodiment to ensure that at least the spider 60, torque head 40, or the tubular retaining apparatus 394 is grippingly engaging the casing string 65 or 30 at all points of the operation.

The operation of the third embodiment of the present invention shown in FIG. 18 is very similar to the operation of the embodiments depicted in FIGS. 9–17, so like parts are labeled with like numbers. This embodiment, however, lacks the pivotable mechanism 345 which is present in FIGS. 9–17. The top drive 50 is connected to the torque head 40 so that the two are substantially coaxial and located within the same plane. A swivel joint (not shown) is preferably located between the top drive 50 and torque head 40 so that the torque head 40 is allowed to transmit torque more efficiently and effectively to the casing 30 relative to top drive 50.

Instead of the pivotable mechanism 345 tilting outward from well center to pick up the casing 30 from the rack 25, the telescopic links 391 pivot relative to the torque head 40, which is rigidly longitudinally fixed above well center, as shown in FIG. 18. Initially, the telescopic links 391 are unactuated so that the pistons 393 are located within the cylinders 392. In this initial position, the telescopic link system 390 is disposed directly below the torque head 40 in line with the torque head 40.

The telescopic link system 390 is pivoted radially outward with respect to the torque head 40 to angle toward the casing 30 disposed on the rack 25. At this time, the telescopic links 391 remain unactuated. Once the tubular retaining apparatus 394 is in position to retrieve the casing 30 from the rack 25, the fluid is introduced into the cylinders 392 behind the pistons 393 to force the pistons 393 outward from the torque head 40 toward the casing 30. The casing 30 is then inserted into the inner diameter of the tubular retaining apparatus 394, which is at this point in its unactuated state.

Once the upper portion of the casing 30 is inserted into the inner diameter of the tubular retaining apparatus 394 so that the tubular retaining apparatus 394 is located below the coupling 396, the gripping members (not shown) of the tubular retaining apparatus 394 are actuated to grippingly engage the casing 30. FIG. 18 shows the tubular retaining apparatus 394 grippingly engaging the outer diameter of the casing 30. Fluid flow behind the pistons 393 is then halted so that the movement of the pistons 393 within the cylinders 392 toward the torque head 40 moves the casing 30 toward well center.

The telescopic link system 390 is then pivoted back to its initial position in line with the torque head 40 and the well center. The assembly is lowered so that a lower end of the casing 30 is placed on an upper end of the casing string 65 previously drilled into the wellbore. Next, the tubular retaining apparatus 394 is unactuated so that the gripping members no longer grippingly engage the outer diameter of the casing 30, and the torque head 40 is no longer axially fixed relative to the casing 30.

The torque head 40 is lowered so that the upper portion of the casing 30 is disposed within the lower portion of the torque head 40. The gripping members of the torque head 40 are actuated to grippingly and sealingly engage the casing 30. The top drive 50 and torque head 40 then torque the threadable connection between the casing strings 30 and 65 as well as drill the casing string 30, 65 into the formation to the desired depth as described above in relation to FIGS. 9–14. The additional steps in the operation are described relative to FIGS. 9–14. Additional casing strings may be drilled further into the formation by repeating the process. The interlock system (not shown) described above may also be utilized with this embodiment to ensure that at least the spider 60, torque head 40, or the tubular retaining apparatus 394 is grippingly engaging the casing string 65 or 30 or the additional casing string at all points of the operation.

Aspects of the present invention provide an apparatus for use with a top drive comprising a top drive adapter connected to a lower end of the top drive, telescopic links pivotably connected to a lower end of the top drive adapter, and a gripping apparatus connected to a lower end of the telescopic links for grippingly engaging a casing string. In one embodiment, the telescopic links are extendable towards and away from the top drive adapter. In another embodiment, the telescopic links pivot away from the top drive to move the casing string from a location away from a well center to the well center. In yet another embodiment, the gripping apparatus comprises a single joint elevator. In yet another embodiment, the telescopic links are hydraulically actuatable to extend and retract towards and away from the gripping head.

In another aspect, the present invention provides a method for moving a casing string to a center of a well comprising providing a top drive and a tubular gripping member pivotally connected by a tubular structural intermediate, pivoting the structural intermediate to bias the tubular gripping member toward the casing string, and grippingly engaging the casing string with the tubular gripping member so that the casing string and the tubular gripping member are rotationally and axially fixed relative to one another and so that fluid is flowable along a substantially sealed fluid path into the top drive and out through the casing string. In another embodiment, the method includes pivoting the structural intermediate to move the casing string to the center of the well.

In another embodiment, a gripping apparatus is connected to a lower portion of the tubular gripping member by telescopic links. The method may also include extending the telescopic links and grippingly engaging the casing string with the gripping apparatus after pivoting the structural intermediate. Thereafter, the telescopic links may be retracted after grippingly engaging the casing string with the gripping apparatus. Then, the structural intermediate is pivoted to move the casing string to the center of the well. In another embodiment, the gripping apparatus comprises a single joint elevator.

In another aspect, the present invention provides a top drive adapter for gripping a casing string in a non-vertical position with respect to the center of a well comprising a tubular gripping member for gripping the casing string in the non-vertical position, and a tubular structural intermediate for biasing the tubular gripping member away from the center of the well, wherein the top drive adapter is rotatable relative to the top drive and fluid is flowable from a top drive through the tubular gripping member.

In another aspect, the present invention provides an apparatus for use with a top drive for picking up a casing string from a location away from a center of a well and moving the casing string toward the center of the well comprising a tubular gripping member attached to a structural intermediate, wherein the structural intermediate is adapted to pivot the tubular gripping member to move the casing string to the center of the well. In one embodiment, the apparatus includes a tubular transport apparatus for transporting the casing string to the tubular gripping member. The tubular transport apparatus may comprise a telescopic link for coupling a gripping apparatus to the tubular gripping member, wherein the telescopic link is extendable from the tubular gripping member and the gripping apparatus. Preferably, the telescopic link comprises a fluid operated piston and cylinder assembly.

In another embodiment, the structural intermediate and the gripping member provide fluid communication to an inner diameter of the casing string. In yet another embodiment, the structural intermediate comprises a first tubular member pivotable with respect to a second tubular member. Preferably, the structural intermediate further comprises a piston and cylinder assembly adapted to pivot the first tubular member relative to the second tubular member.

In another aspect, the present invention provides a method of forming a wellbore with a tubular string having a first tubular and a second tubular. The method includes providing a top drive operatively connected to a torque head, the torque head having a retaining member; engaging the first tubular with a pipe handling arm; engaging the first tubular with the second tubular; actuating the retaining member to radially engage the first tubular; rotating the first tubular with respect to the second tubular; and rotating the tubular string using the top drive, thereby forming the wellbore. In one embodiment, rotating the first tubular with respect to the second tubular comprises rotating the torque head. In another embodiment, the method further includes actuating the pipe handling arm to rotate the first tubular with respect to the second tubular. In yet another embodiment, method also includes performing a portion of a make up process using the pipe handling arm and completing the make up process using the top drive.

Aspects of the present invention provides an apparatus for connecting a first tubular with a second tubular comprising a gripping member for engaging the first tubular; a conveying member for positioning the gripping member; and a spinner coupled to the gripping member for rotating the first tubular. The spinner may be actuated to rotate, preferably continuously, the first tubular relative to the second tubular. In one embodiment, the spinner performs a portion of the make up process and the top drive performs the remaining portion of the make up process. The spinner may comprise a motor and one or more rotational members for engaging the first tubular. The one or more rotational members comprise a roller. In another embodiment, a rotation counting member is provided and may be biased against the first tubular.

In another embodiment, apparatus includes a sensor responsive to a position of the gripping member and means for memorizing the position of the gripping member, wherein the apparatus is capable of returning the gripping member to the memorized position. In yet another embodiment, the gripping member is remotely controllable. In yet another embodiment, the conveying member is coupled to an axially movable base. In yet another embodiment, the apparatus is mounted on a rail. In yet another embodiment, the conveying member comprises a telescopic arm. In yet another embodiment, the telescopic arm is mounted on a rotor which is pivotally mounted on a base. In yet another embodiment, the spinner rotates the first tubular relatively faster than a top drive.

In another aspect, the present invention provides a method of connecting a first tubular to a second tubular. The method includes engaging the first tubular using a gripping member connected to a conveying member; positioning the gripping member to align the first tubular with the second tubular; engaging the first tubular with the second tubular; and actuating the gripping member to rotate the first tubular relative to the second tubular, thereby connecting the first tubular to the second tubular. In one embodiment, the method further comprises determining a position of the gripping member, wherein the position of the gripping member aligns the first tubular with the second tubular, and memorizing the position of the gripping member. The method may also include recalling the memorized position to position a third tubular. In yet another embodiment, the method also includes detecting a rotation of the first tubular. In yet another embodiment, the method further comprises providing a rotation counting member to detect the rotation of the first tubular.

In another aspect, the present invention provides a top drive system for forming a wellbore with a tubular comprising a top drive, a gripping head operatively connected to the top drive, and a pipe handling arm. In one embodiment, the pipe handling arm includes a gripping member for engaging the tubular, a conveying member for positioning the gripping member, and a spinner for connecting the first tubular to the second tubular. In another embodiment, the top drive system includes an elevator and one or more bails operatively connecting the elevator to the top drive. In yet another embodiment, the spinner comprises one or more rotational members for engaging the tubular.

In another aspect, the present invention provides a method of forming a wellbore with a tubular string having a first tubular and a second tubular. The method includes providing a top drive operatively connected to a top drive adapter, engaging the first tubular with a pipe handling arm, engaging the first tubular with the second tubular, rotating the first tubular with respect to the second tubular using the pipe handling arm, engaging the first tubular with the top drive adapter, and rotating the tubular string using the top drive, thereby forming the wellbore. In one embodiment, the method also includes aligning the first tubular with the second tubular. The method may also include manipulating the pipe handling arm to align the first tubular with the second tubular. In another embodiment, the method includes the top drive supplying a greater amount of torque than the pipe handling arm. In yet another embodiment, the pipe handling arm rotates the first tubular faster than the top drive. In yet another embodiment, the method includes engaging the tubular string with a spider. In yet another embodiment, the method includes cementing the tubular string.

In another aspect, the present invention provides a top drive adapter for use with a top drive to grip a tubular comprising a housing operatively connected to the top drive, a plurality of retaining members circumferentially disposed in the housing for gripping the tubular, wherein the plurality of retaining members are radially extendable to engage an outer portion of the tubular. In one embodiment, radial movement of the plurality of retaining members is substantially horizontal. In another embodiment, apparatus includes an insert disposed on the plurality of retaining members. In a further embodiment still, the insert is axially movable relative to the plurality of retaining members. In a further embodiment still, a contact surface between the insert and the plurality of retaining members is tapered relative to a central axis. In a further embodiment still, a biasing member is provided for moving the insert. In a further embodiment still, each of the plurality of retaining members comprises a jaw. In a further embodiment still, a piston and cylinder assembly for moving the jaw radially to engage the tubular. In a further embodiment still, the jaw is pivotably connected to the piston and cylinder assembly. In a further embodiment still, an axial load acting on the plurality of retaining members is transmitted to the housing. In a further embodiment still, the plurality of retaining members engage a coupling on the tubular. In a further embodiment still, an axial load is transferred from the coupling to the plurality of retaining members. In a further embodiment still, the apparatus also includes a guide plate for guiding the tubular into the housing. In a further embodiment still, the guide plate is adjustable to guide various sized tubulars. In a further embodiment still, apparatus also includes a tubular stop member disposed in the housing. In a further embodiment still, the apparatus also includes a circulating tool disposed in the housing. In a further embodiment still, the circulating tool is in fluid communication with the top drive.

In another aspect, the present invention provides an apparatus for connecting a first tubular with a second tubular comprising a gripping member for engaging the first tubular, a conveying member for positioning the gripping member, and a spinner coupled to the gripping member for rotating the first tubular. In one embodiment, the spinner rotates the first tubular relative to the second tubular. In another embodiment, the spinner continuously rotates the first tubular to the second tubular to make up the connection. In a further embodiment still, the apparatus also includes a rotation counting member. In a further embodiment still, the apparatus also includes a sensor responsive to a position of the gripping member and means for memorizing the position of the gripping member, wherein the apparatus is capable of returning the gripping member to the memorized position. In a further embodiment still, the gripping member is remotely controllable. In a further embodiment still, the conveying member is coupled to an axially movable base.

In another aspect, the present invention provides a method of forming a wellbore with a tubular string having a first tubular and a second tubular comprising providing a top drive operatively connected to a top drive adapter, engaging the first tubular with a pipe handling arm, engaging the first tubular with the second tubular, rotating the first tubular with respect to the second tubular using the pipe handling arm, engaging the first tubular with the top drive adapter, and rotating the tubular string using the top drive, thereby forming the wellbore.

While the foregoing is directed to embodiments of the present invention, other and further embodiments of the invention may be devised without departing from the basic scope thereof, and the scope thereof is determined by the claims that follow.

We claim:

1. An apparatus for use with a top drive comprising:

a pivotable mechanism connected to a lower end of the top drive;

a top drive adapter connected proximate to a lower end of the pivotable mechanism and movable toward and away from the top drive by the pivotable mechanism, the top drive adapter capable of transferring torque to a wellbore tubular; and a tubular transport apparatus connected to a lower end of the top drive adapter, wherein the tubular transport apparatus is adapted to deliver the wellbore tubular into engagement with the top drive adapter.

2. The apparatus of claim 1, wherein the tubular transport apparatus comprises a telescopic link extendable from the top drive adapter and a gripping apparatus for grippingly engaging the casing string.

3. The apparatus of claim 2, wherein the telescopic link comprises a fluid actuated piston and cylinder assembly.

4. The apparatus of claim 2, wherein the gripping apparatus comprises an elevator.

5. The apparatus of claim 1, wherein the pivotable mechanism comprises a tubular member pivotably connected to an articulating arm, wherein the articulating arm is pivotable towards and away from the top drive.

6. The apparatus of claim 5, wherein a hydraulically actuated piston within a cylinder is pivotably connected at an end to the articulating arm and at another end to the tubular member.

7. The apparatus of claim 1, wherein the pivotable mechanism comprises a bore therethrough for fluid communication.

8. The apparatus of claim 1, wherein the top drive adapter comprises a torque head.

9. The apparatus of claim 1, wherein the top drive adapter comprises a spear.

10. A method for drilling with casing with a top drive, comprising:

providing a tubular gripping member pivotally connected to the top drive, wherein the tubular gripping member is rotatable by the top drive;

pivoting the tubular gripping member away from the center of the well;

engaging a casing with the tubular gripping member; and pivoting the tubular gripping member toward the center of the well, wherein the tubular gripping member comprises a torque head having a housing and a plurality of retaining members disposed in the housing for gripping the tubular, wherein the plurality of gripping members are actuatable radially to engage the tubular.

11. The method of claim 10, further comprising aligning the casing with a second casing using a tubular positioning apparatus.

12. The method of claim 11, further comprising rotating the casing using the tubular positioning apparatus.

13. The method of claim 12, further comprising rotating the casing using the top drive.

14. The method of claim 11, further comprising memorizing a position of the tubular positioning apparatus.

15. The method of claim 11, wherein the tubular positioning apparatus comprises a pipe handling arm.

16. The method of claim 10, further comprising circulating a fluid in the casing.

17. The method of claim 10, further comprising connecting the casing to a second casing having a cutting structure disposed at its lower end disposed in a formation.

18. The method of claim 17, further comprising rotating the second casing while urging the second urging into the formation.

19. The method of claim 18, further comprising circulating a fluid into the top drive and the second casing.

20. The method of claim 10, wherein a structural intermediate pivotally connects the tubular gripping member to the top drive.

21. The method of claim 20, wherein fluid is flowable through a bore through the structural intermediate.

22. The method of claim 21, wherein the structural intermediate is rotationally fixed relative to the tubular gripping member and is rotatable relative to the top drive.

23. A top drive system for handling a tubular, comprising:

a top drive;

a top drive adapter operatively connected to the top drive, the top drive adapter capable of retaining and transferring torque to the tubular;

a tubular positioning apparatus for manipulating the tubular, the tubular positioning apparatus capable of rotating the tubular; and a tubular transport apparatus operatively coupled to at least one of the top drive and the top drive adapter, the tubular transport apparatus adapted to move the tubular into engagement with the top drive adapter.

24. The top drive system of claim 23, further comprising a structural intermediate coupling the top drive adapter to the top drive, wherein the structural intermediate is capable of pivoting the top drive adapter away from an axis of the top drive.

25. The top drive system of claim 23, wherein the tubular transport apparatus comprises an extension member and a gripping apparatus.

26. The top drive system of claim 23, wherein the top drive adapter is adapted to engage an outer portion of the tubular.

27. The top drive system of claim 23, wherein the top drive adapter is adapted to engage an inner portion of the tubular.

28. The top drive system of claim 23, further comprising a safety interlock to ensure the tubular is retained.

29. The top drive system of claim 23, further comprising a fill-up tool.

30. A top drive adapter for use with a top drive to grip a tubular, comprising:

a housing operatively connected to the top drive;

a plurality of retaining members circumferentially disposed in the housing for gripping the tubular, wherein the plurality of retaining members are radially extendable to engage an outer portion of the tubular; and a guide plate for guiding the tubular into the housing.

31. The adapter of claim 30, wherein radial movement of the plurality of retaining members is substantially horizontal.

32. The adapter of claim 30, further comprising an insert disposed on the plurality of retaining members.

33. The adapter of claim 30, wherein each of the plurality of retaining members comprises a jaw.

34. The adapter of claim 30, wherein an axial load acting on the plurality of retaining members is transmitted to the housing.

35. An apparatus for use with a top drive comprising:

a pivotable mechanism connected to a lower end of the top drive, the pivotable mechanism comprising:

a tubular member pivotably connected to an articulating arm, wherein the articulating arm is pivotable towards and away from the top drive; and a hydraulically actuated piston and cylinder assembly is pivotably connected at one end to the articulating arm and at another end to the tubular member; and a top drive adapter connected proximate to a lower end of the pivotable mechanism and movable toward and away from the top drive by the pivotable mechanism, the top drive adapter capable of transferring torque to a wellbore tubular.

* * * * *

UNITED STATES PATENT AND TRADEMARK OFFICE

CERTIFICATE OF CORRECTION

PATENT NO. : 7,140,445 B2
APPLICATION NO. : 10/794797
DATED : November 28, 2006
INVENTOR(S) : Shahin et al.

It is certified that error appears in the above-identified patent and that said Letters Patent is hereby corrected as shown below:

On the Title Page:

Under Related U.S. Application Data, please replace Section (63) with the following:

Continuation-in-part of application No. 10/382,353, filed on Mar. 5, 2003, which is a continuation-in-part of application No. 09/486,901, filed on May 19, 2000, now Pat. No. 6,591,471, which is a 371 of PCT/GB98/02582, filed on September 2, 1998, and a continuation-in-part of application No. 10/625,840, filed on Jul. 23, 2003, now Pat No. 7,073,598, which is a continuation of application No. 09/860,127, filed on May 17, 2001, now Pat. No. 6,742,596, and a continuation-in-part of application No. 10/389,483, filed on March 14, 2003, which claims benefit of application No. 09/550,721, filed on Apr. 17, 2000, now Pat. No. 6,536,520, and a continuation-in-part of application No. 10/354,226, filed on Jan. 29, 2003, now Pat. No. 6,688,398, which claims benefit of application No. 09/762,698, filed on Aug. 16, 1999, now Pat. No. 6,527,047.

Signed and Sealed this

Seventeenth Day of July, 2007

JON W. DUDAS
*Director of the United States Patent and Trademark Office*